US007907869B2

(12) United States Patent
Takenaka et al.

(10) Patent No.: US 7,907,869 B2
(45) Date of Patent: Mar. 15, 2011

(54) CHARGING BRUSH UNIT, CHARGING DEVICE, AND IMAGE FORMING APPARATUS

(75) Inventors: Kohta Takenaka, Yokohama (JP); Kazunori Bannai, Atsugl (JP); Hidehiko Fujiwara, Tokyo (JP); Yu Wakabayashi, Fujisawa (JP)

(73) Assignee: Ricoh Company Limited, Tokyo (JP)

( * ) Notice: Subject to any disclaimer, the term of this patent is extended or adjusted under 35 U.S.C. 154(b) by 424 days.

(21) Appl. No.: 12/046,778

(22) Filed: Mar. 12, 2008

(65) Prior Publication Data

US 2008/0304866 A1 Dec. 11, 2008

(30) Foreign Application Priority Data

Mar. 13, 2007 (JP) ..... 2007-063975
Dec. 17, 2007 (JP) ..... 2007-324814

(51) Int. Cl.
*G03G 15/02* (2006.01)

(52) U.S. Cl. ..... 399/115; 399/168; 399/171

(58) Field of Classification Search ..... 399/50, 399/115, 168, 171, 175
See application file for complete search history.

(56) References Cited

U.S. PATENT DOCUMENTS 4,761,709 A * 8/1988 Ewing et al. ..... 361/225
5,832,346 A * 11/1998 Lewis ..... 399/168
6,081,681 A * 6/2000 Nagase et al. ..... 399/174
6,393,237 B1 * 5/2002 Shindo ..... 399/171
6,553,198 B1 * 4/2003 Slattery et al. ..... 399/171
2003/0231901 A1 * 12/2003 Foltz ..... 399/171
2006/0193657 A1 * 8/2006 Zona et al. ..... 399/170
2007/0212111 A1 * 9/2007 Kagawa et al. ..... 399/168
2008/0253805 A1 * 10/2008 Yoshino ..... 399/171
2010/0104315 A1 * 4/2010 Moser et al. ..... 399/100

FOREIGN PATENT DOCUMENTS

JP 2006-84951 3/2006
JP 2006-221091 8/2006
JP 2006-243286 9/2006
JP 3878388 11/2006

* cited by examiner

*Primary Examiner* — David M Gray
*Assistant Examiner* — G. M. Hyder
(74) *Attorney, Agent, or Firm* — Oblon, Spivak, McClelland, Maier & Neustadt, L.L.P.

(57) ABSTRACT

A charging brush unit includes a brush and a conductive holder. The brush includes a plurality of flexible conductive fibers. The plurality of flexible conductive fibers is supplied with a charging bias to generate electrical discharge between a top of the plurality of conductive fibers and a latent image carrier across a gap formed between the top of the plurality of conductive fibers and the latent image carrier. The gap is provided with an electrode. The electrode includes a plurality of openings opposing the top of the plurality of conductive fibers and is supplied with a bias different from the charging bias applied to the plurality of conductive fibers. The conductive holder holds the brush.

20 Claims, 22 Drawing Sheets

CHARGING BRUSH UNIT, CHARGING DEVICE, AND IMAGE FORMING APPARATUS

CROSS-REFERENCE TO RELATED APPLICATIONS

The present application is based on and claims priority from Japanese Patent Application Nos. 2007-063975, filed on Mar. 13, 2007, and 2007-324814, filed on Dec. 17, 2007 in the Japan Patent Office, the entire contents of each of which are hereby incorporated herein by reference.

BACKGROUND OF THE INVENTION

1. Field of the Invention

Exemplary aspects of the present invention relate to a charging brush unit, a charging device, and an image forming apparatus, and more particularly, to a charging brush unit, a charging device, and an image forming apparatus for uniformly charging a latent image carrier.

2. Description of the Related Art

A related-art image forming apparatus, such as a copier, a facsimile machine, a printer, or a multifunction printer having two or more of copying, printing, scanning, and facsimile functions, forms a toner image on a recording medium (e.g., a recording sheet) according to image data by electrophotography. For example, a charging device charges a surface of a latent image carrier. An optical writer emits a light beam onto the charged surface of the latent image carrier to form an electrostatic latent image on the latent image carrier according to the image data. A development device develops the electrostatic latent image with a developer (e.g., toner) to form a toner image on the latent image carrier. The toner image is transferred from the latent image carrier onto a recording sheet via an intermediate transfer belt. A fixing device applies heat and pressure to the recording sheet bearing the toner image to fix the toner image on the recording sheet. Thus, the toner image is formed on the recording sheet.

As the charging device for charging the surface of the latent image carrier, a scorotron charging device is known. The scorotron charging device includes a grid electrode and a wire. The grid electrode has a mesh-like shape and opposes a latent image carrier at a predetermined distance. The wire is stretched so that a circumferential surface thereof opposes the latent image carrier via the grid electrode. When a predetermined bias is applied to the wire, and the grid electrode is supplied with a bias closer to a uniform charging potential of the latent image carrier than the bias applied to the wire, corona discharge occurs between the circumferential surface of the wire and the latent image carrier. Accordingly, the surface of the latent image carrier is uniformly charged with a polarity identical to that of the bias applied to the wire. It is to be noted that in order to generate the corona discharge between the wire and the latent image carrier, a voltage of 5 kV or higher needs to be applied to the wire.

One example of a related art charging device includes a so-called sawtooth discharging electrode instead of a wire. The sawtooth discharging electrode includes a plurality of sharp teeth and opposes a latent image carrier via a mesh-like grid electrode. When the discharging electrode is supplied with a bias, electrical charges are concentrated at the plurality of sharp teeth of the discharging electrode opposing the grid electrode, and thus corona discharge occurs at a lower voltage than the voltage applied in the above scorotron charging device including the wire.

However, when the corona discharge occurs, an electrical current flows only from a top of a tooth of the sawtooth discharging electrode, not from the whole surface of the sawtooth discharging electrode opposing the grid electrode. As a result, the latent image carrier may not be uniformly charged. Further, although the related-art charging device may generate the corona discharge at a decreased voltage compared to the scorotron charging device, nevertheless it still needs a voltage of at least 4 kV or higher.

BRIEF SUMMARY OF THE INVENTION

This specification describes a charging brush unit according to exemplary embodiments of the present invention. In one exemplary embodiment of the present invention, the charging brush unit includes a brush and a conductive holder. The brush includes a plurality of flexible conductive fibers. The plurality of flexible conductive fibers is supplied with a charging bias to generate electrical discharge between a top of the plurality of conductive fibers and a latent image carrier across a gap formed between the top of the plurality of conductive fibers and the latent image carrier. An electrode is provided in the gap and includes a plurality of openings opposing the top of the plurality of conductive fibers, and is supplied with a bias different from the charging bias applied to the plurality of conductive fibers. The conductive holder is configured to hold the brush.

This specification further describes a charging device according to exemplary embodiments of the present invention. In one exemplary embodiment of the present invention, the charging device includes a charging brush unit and an electrode. The charging brush unit includes a brush and a conductive holder. The brush includes a plurality of flexible conductive fibers. The plurality of flexible conductive fibers is supplied with a charging bias to generate electrical discharge between a top of the plurality of conductive fibers and the latent image carrier across a gap formed between the top of the plurality of conductive fibers and the latent image carrier. The conductive holder is configured to hold the brush. The electrode includes a plurality of openings opposing the top of the plurality of conductive fibers, and is supplied with a bias different from the charging bias applied to the plurality of conductive fibers, so that the electrical discharge is generated between the plurality of conductive fibers and the latent image carrier via the electrode.

This specification further describes an image forming apparatus according to exemplary embodiments of the present invention. In one exemplary embodiment of the present invention, the image forming apparatus includes a latent image carrier, a charging device, a latent image forming member, and a development device. The latent image carrier is configured to carry a latent image. The charging device is configured to uniformly charge a surface of the latent image carrier. The charging device includes a charging brush unit and an electrode as described above. The latent image forming member is configured to form a latent image on the uniformly charged surface of the latent image carrier. The development device is configured to develop the latent image.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
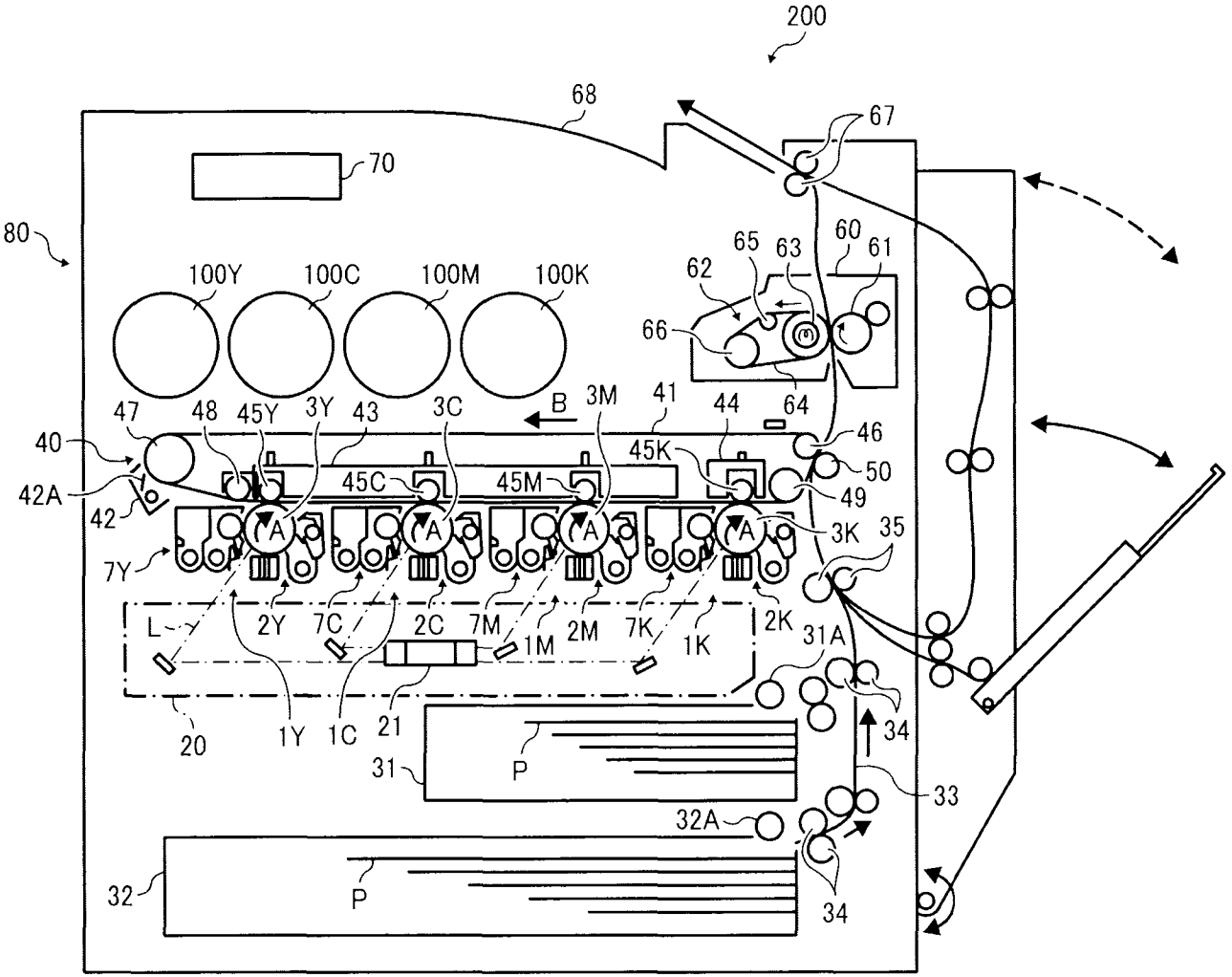
FIG. 1 illustrates one example of a tandem type image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 200 according to an exemplary embodiment of the present invention is described.

FIG. 1 illustrates one example of the tandem type image forming apparatus 200 (e.g., an electrophotographic printer). The image forming apparatus 200 includes a body 80 and a stacking device 68. The body 80 includes process units 1Y, 1C, 1M, and 1K, an optical writer 20, a first paper tray 31, a second paper tray 32, a first feed roller 31A, a second feed roller 32A, a feeding path 33, a plurality of conveyance roller pairs 34, a registration roller pair 35, a transfer device 40, a fixing device 60, a discharge roller pair 67, a controller 70, and toner cartridges 100Y, 100C, 100M, and 100K. The process units 1Y, 1C, 1M, and 1K include photoconductor units 2Y, 2C, 2M, and 2K and development units 7Y, 7C, 7M, and 7K, respectively. The photoconductor units 2Y, 2C, 2M, and 2K include photoconductors 3Y, 3C, 3M, and 3K, respectively. The optical writer 20 includes a polygon mirror 21. The transfer device 40 includes an intermediate transfer belt 41, a belt cleaner 42, a first bracket 43, a second bracket 44, first transfer rollers 45Y, 45C, 45M, and 45K, a second transfer backup roller 46, a driving roller 47, a supplementary roller 48, a tension roller 49, and a second transfer roller 50. The belt cleaner 42 includes a cleaning blade 42A. The fixing device 60 includes a press heating roller 61 and a fixing belt member 62. The fixing belt member 62 includes a fixing belt 64, a heating roller 63, a tension roller 65, and a driving roller 66.

Figure 2:
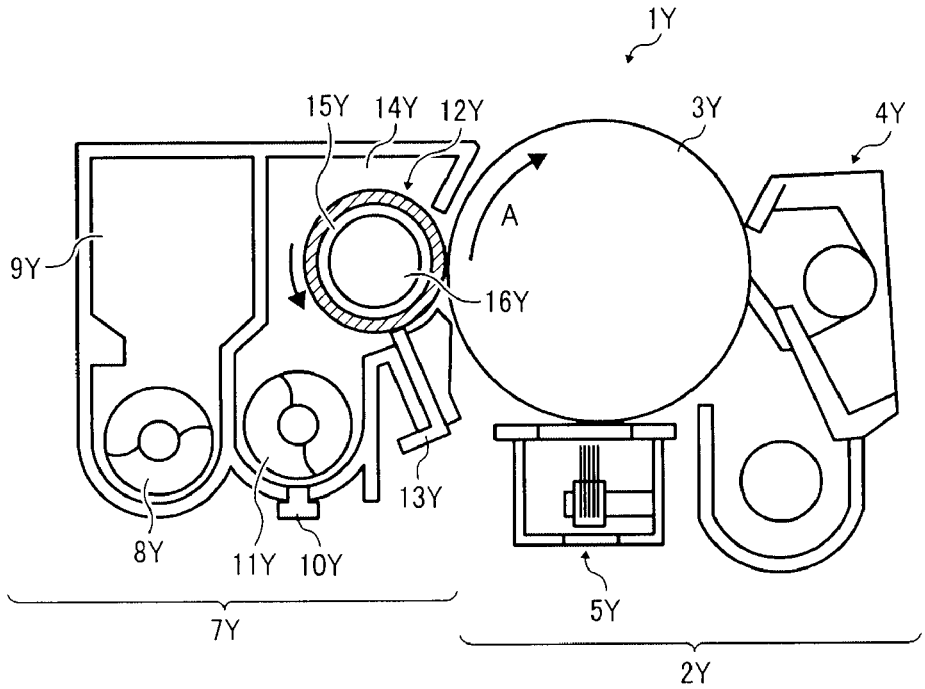
FIG. 2 is a schematic view of a process unit included in the image forming apparatus shown in FIG. 1.

FIG. 2 is a schematic view of the process unit 1Y. The photoconductor unit 2Y further includes a drum cleaner 4Y and a charging device 5Y. The development unit 7Y includes a first developer container 9Y and a second developer container 14Y. The first developer container 9Y includes a first conveyance screw 8Y. The second developer container 14Y includes a toner density sensor 10Y, a second conveyance screw 11Y, a development roller 12Y, and a doctor blade 13Y. The development roller 12Y includes a development sleeve 15Y and a magnetic roller 16Y.

Figure 3:
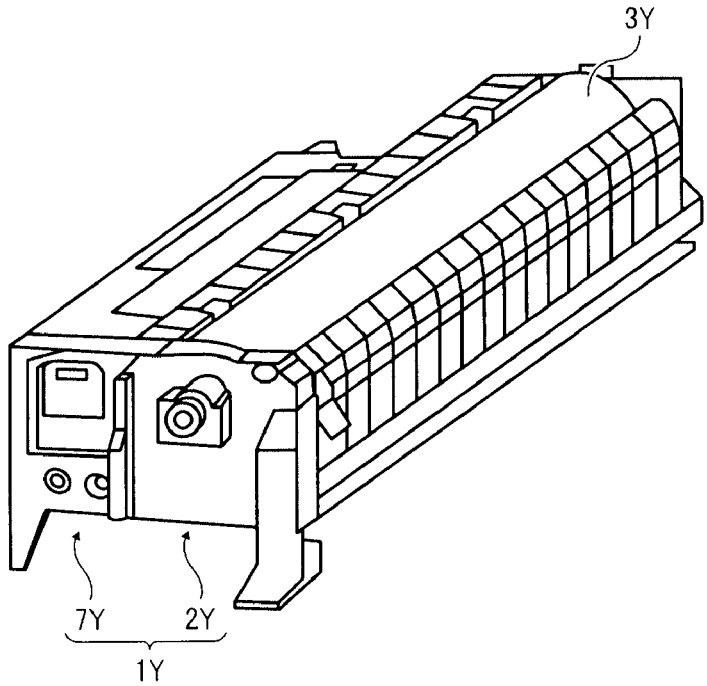
FIG. 3 a perspective view of the process unit shown in FIG. 2.
Figure 4:
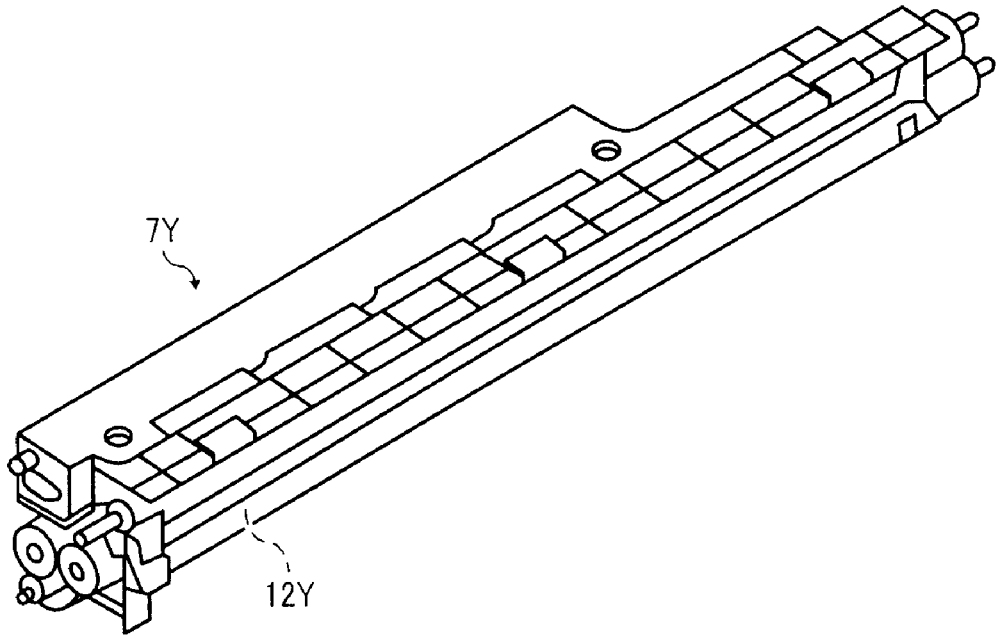
FIG. 4 is a perspective view of a development unit included in the process unit shown in FIG. 3.

FIG. 3 is a perspective view of the process unit 1Y. FIG. 4 is a perspective view of the development unit 7Y.

The respective process units 1Y, 1C, 1M, and 1K (depicted in FIG. 1) correspond to yellow, cyan, magenta, and black toner, respectively, and have a common structure. Therefore, redundant descriptions thereof are omitted here.

As illustrated in FIG. 3, the photoconductor unit 2Y and the development unit 7Y are integrally provided in the process unit 1Y, and attachable to and detachable from the body 80 of the image forming apparatus 200 (depicted in FIG. 1). However, when the process unit 1Y including the photoconductor unit 2Y and the development unit 7Y is detached from the body 80, the development unit 7Y is attachable to and detachable from the photoconductor unit 2Y, as illustrated in FIG. 4. Alternatively, the charging device 5Y may include the photoconductor 3Y, and thus a charging brush 507Y described later and the photoconductor 3Y may be integrally attached to and detached from the body 80 of the image forming apparatus 200.

As illustrated in FIG. 2, the photoconductor 3Y, serving as a latent image carrier, has a drum-like shape and includes an organic photoconductor with a multi-layered structure in which an aluminum tube is coated with an electrical charge generation layer and an electrical charge transport layer, but may include a single layer structure.

The charging device 5Y uniformly charges a surface of the photoconductor 3Y driven to rotate clockwise (e.g., a direction A) by a driver, not shown. After the optical writer 20 (depicted in FIG. 1) emits a laser beam to the charged surface of the photoconductor 3Y to expose and scan the surface of the photoconductor 3Y, an electrostatic latent image is formed thereon.

The first developer container 9Y and the second developer container 14Y store a yellow developer including a magnetic carrier and negatively charged yellow toner. The first conveyance screw 8Y is driven to rotate by a driver, not shown, and conveys the yellow developer in the first developer container 9Y in a direction perpendicular to a surface of the drawing (e.g., a longitudinal direction of the first conveyance screw 8Y). The yellow developer passes through a hole, not shown, on a dividing wall provided between the first developer container 9Y and the second developer container 14Y, and enters the second developer container 14Y.

The second conveyance screw 11Y of the second developer container 14Y is driven to rotate by a driver, not shown, and conveys the yellow developer in the direction perpendicular to the surface of the drawing (e.g., a direction opposite to the direction in which the first conveyance screw 8Y conveys the yellow developer). The toner density sensor 10Y (e.g., a permeability sensor) is fixed to a bottom of the second developer container 14Y and detects a density of the conveyed yellow developer. Above the second conveyance screw 11Y is provided the development roller 12Y in parallel with the second conveyance screw 11Y. The development sleeve 15Y of the development roller 12Y includes a nonmagnetic pipe driven to rotate counterclockwise. The magnetic roller 16Y is provided in the development sleeve 15Y. Some of the yellow developer conveyed by the second conveyance screw 11Y is attracted toward a surface of the development sleeve 15Y by a magnetic force of the magnetic roller 16Y. The doctor blade 13Y is provided such that a predetermined space is maintained between the development sleeve 15Y and the doctor blade 13Y, so as to control thickness of the yellow developer. Then, the yellow developer is conveyed to a development area opposing the photoconductor 3Y and adhered to the electrostatic latent image formed on the photoconductor 3Y, thereby a yellow toner image is formed on the photoconductor 3Y. After the development, the yellow developer loses the yellow toner and returns to the second conveyance screw 11Y according to rotation of the development sleeve 15Y of the development roller 12Y. Then, the yellow developer is conveyed to a hole, not shown, provided near one end of the second conveyance screw 11Y in a longitudinal direction of the second conveyance screw 11Y, and returns to the first developer container 9Y through the hole.

The toner density sensor 10Y detects magnetic permeability of the yellow developer and transmits a result thereof to the controller 70 (depicted in FIG. 1) as a voltage signal. Since the magnetic permeability of the yellow developer is related to the yellow toner density of the yellow developer, the toner density sensor 10Y outputs a value of a voltage corresponding to the yellow toner density. The controller 70 includes a data storage device such as a RAM (random access memory) and the like storing data including a Vtref for yellow toner, which is a reference value of an output voltage from the toner density sensor 10Y, and other Vtrefs for cyan, magenta, and black toner, which are reference values of output voltages from the toner density sensors of the development units 7C, 7M, and 7K. The controller 70 compares the value of the voltage output from the toner density sensor 10Y with the value of Vtref for yellow toner, and drives a toner supplier, not shown, for a period of time based on the comparison result. The toner supplier supplies an appropriate amount of yellow toner to the first developer container 9Y so as to compensate for the shortage of yellow toner included in the yellow developer caused by development of the electrostatic latent image. As a result, the yellow toner density inside the second developer container 14Y is maintained in a predetermined range. Like the process unit 1Y, the other process units 1C, 1M, and 1K perform an equivalent toner supply control, respectively.

The yellow toner image formed on the photoconductor 3Y is transferred to the intermediate transfer belt 41 (depicted in FIG. 1) described later. The drum cleaner 4Y of the photoconductor unit 2Y removes residual toner remaining on the surface of the photoconductor 3Y. The cleaned surface of the photoconductor 3Y is discharged by a discharger, not shown, to be initialized, so as to prepare for a subsequent image formation. Like the process unit 1Y, the other process units 1C, 1M, and 1K form cyan, magenta, and black toner images on the photoconductors 3C, 3M, and 3K, respectively, and the respective toner images are transferred to the intermediate transfer belt 41.

As illustrated in FIG. 1, the optical writer 20 is provided below the process units 1Y, 1C, 1M, and 1K. The optical writer 20, serving as a latent image forming member, irradiates a laser beam L emitted based on image information on surfaces of the photoconductors 3Y, 3C, 3M, and 3K of the process units 1Y, 1C, 1M, and 1K, thereby forming electrostatic latent images for yellow, cyan, magenta, and black toner on the photoconductors 3Y, 3C, 3M, and 3K, respectively. After emitted from a light source, not shown, of the optical writer 20, the laser beam L is deflected by the polygon mirror 21 driven to rotate by a motor, not shown, and irradiated to the surfaces of the photoconductors 3Y, 3C, 3M, and 3K through a pluralities of optical lenses and mirrors, not shown. Alternatively, the optical writer 20 may use a LED (light-emitting diode) array for performing light scanning.

The first paper tray 31 and the second paper tray 32 are provided below the optical writer 20 such that the first paper tray 31 and the second paper tray 32 are layered in a vertical direction, and store a plurality of recording materials (e.g., recording sheet P), respectively. The first feed roller 31A and the second feed roller 32A contact an uppermost recording sheet P, respectively. When the first feed roller 31A is driven to rotate counterclockwise by a driver, not shown, the uppermost recording sheet P in the first paper tray 31 is discharged toward the vertically extending feeding path 33. Also, when the second feed roller 32A is driven to rotate counterclockwise by a driver, not shown, the uppermost recording sheet P in the second paper tray 32 is discharged toward the feeding path 33. The recording sheet P fed to the feeding path 33 is sandwiched between the plurality of conveyance roller pairs 34 provided in the feeding path 33 and conveyed upwards through the feeding path 33.

The registration roller pair 35 is provided in an end of the feeding path 33. When the recording sheet P is fed from the conveyance roller pair 34, the registration roller pair 35 sandwiches the recording sheet P and temporarily stops rotation. Then, the registration roller pair 35 feeds the recording sheet P toward a second transfer nip described below at a proper time.

The transfer unit 40 is provided above the process units 1Y, 1C, 1M, and 1K. The intermediate transfer belt 41 of the transfer device 40 is looped over the first transfer rollers 45Y, 45C, 45M, and 45K, the second transfer backup roller 46, the driving roller 47, the supplementary roller 48, and the tension roller 49. The intermediate transfer belt 41 moves counterclockwise (e.g., a direction B) by rotation of the driving roller 47. The intermediate transfer belt 41 is sandwiched between the first transfer rollers 45Y, 45C, 45M, and 45K and the photoconductors 3Y, 3C, 3M, and 3K to form first transfer nips, respectively. Then, a transfer bias (e.g., a positive bias) with a porality opposite to a polarity of toner is applied to a back surface (e.g., an inner circumferential surface) of the intermediate transfer belt 41. The yellow, cyan, magenta, and black toner images formed on the photoconductors 3Y, 3C, 3M, and 3K are first-transferred and superimposed on a front surface of the intermediate transfer belt 41 while sequentially passing through the respective transfer nips formed between the first transfer rollers 45Y, 45C, 45M, and 45K and the photoconductors 3Y, 3C, 3M, and 3K. Accordingly, four color toner images are superimposed on the intermediate transfer belt 41.

The intermediate transfer belt 41 is sandwiched between the second transfer backup roller 46 and the second transfer roller 50 provided to face an outer circumferential surface of the intermediate transfer belt 41 to form a second transfer nip. The registration roller pair 35 feeds the recording sheet P toward the second transfer nip when the four color toner images carried by the intermediate transfer belt 41 reach the second transfer nip. Due to effects of a second transfer bias applied to the second transfer roller 50 to form a second transfer electrical field and nip pressure between the second transfer roller 50 and the second transfer backup roller 46, the four color toner images are second-transferred to the recording sheet P at the second transfer nip. The transferred four color toner images form a full color toner image on the white recording sheet P.

The belt cleaner 42 removes residual toner remaining on the intermediate transfer belt 41 after passing through the second transfer nip. The cleaning blade 42A of the belt cleaner 42 contacts the front surface of the intermediate transfer belt 41, and removes the residual toner on the intermediate transfer belt 41 by scraping it.

Driving force of a solenoid, not shown, causes the first bracket 43 of the transfer device 40 to swing at a predetermined rotation angle around a rotation axis of the supplementary roller 48. When the image forming apparatus 200 forms a monochrome image, the solenoid slightly rotates the first bracket 43 counterclockwise. The rotation causes the first transfer rollers 45Y, 45C, and 45M to rotate counterclockwise around the rotation axis of the supplementary roller 48, thereby separating the intermediate transfer belt 41 from the photoconductors 3Y, 3C, and 3M. Meanwhile, the process unit 1K is activated so as to form the monochrome image. Accordingly, when the monochrome image is formed, the process units 1Y, 1C, and 1M are not redundantly driven, and thereby may be prevented from being worn.

The fixing device 60 is provided above the second transfer nip. The press heating roller 61 of the fixing device 60 includes a heat source such as a halogen lump or the like. The heating roller 63 of the fixing belt member 62 also includes a heat source such as a halogen lump or the like. The endless fixing belt 64 is looped over the heating roller 63, the tension roller 65, and the driving roller 66, and moves counterclockwise. The heating roller 63 heats a back surface of the moving fixing belt 64. The press heating roller 61 is driven to rotate clockwise and contacts a front surface of the fixing belt 64 looped over the heating roller 63, thereby forming a fixing nip between the press heating roller 61 and the fixing belt 64.

A temperature sensor, not shown, is provided outside a loop of the fixing belt 64, and faces the front surface of the fixing belt 64 via a predetermined space, and detects a surface temperature of the fixing belt 64 immediately before the fixing belt 64 passes through the fixing nip. A result thereof is transmitted to a power circuit, not shown. Based on the result, the power circuit performs control of supplying power to the heat source of the heating roller 63 or the heat source of the press heating roller 61, thereby maintaining the surface temperature of the fixing belt 64 at about 140 degrees centigrade.

After passing through the second transfer nip, the recording sheet P is conveyed from the intermediate transfer belt 41 to the fixing device 60. When the recording sheet P is conveyed upwards and passes through the fixing nip between the fixing belt 64 and the press heating roller 61, the full color toner image is fixed to the recording sheet P by heat and pressure of the fixing belt 64.

The recording sheet P bearing the fixed full color toner image is discharged to an outside of the image forming apparatus 200 via the discharge roller pair 67. The discharged recording sheet P is sequentially stacked on the stacking device 68 provided on the body 80 of the image forming apparatus 200.

The toner cartridges 100Y, 100C, 100M, and 100K are provided above the transfer device 40 and respectively store yellow, cyan, magenta, and black toner, which are supplied to the development units 7Y, 7C, 7M, and 7K of the process units 1Y, 1C, 1M, and 1K. The toner cartridges 100Y, 100C, 100M, and 100K are attachable to and detachable from the body 80 separately from the process units 7Y, 7C, 7M, and 7K.

Figure 5:
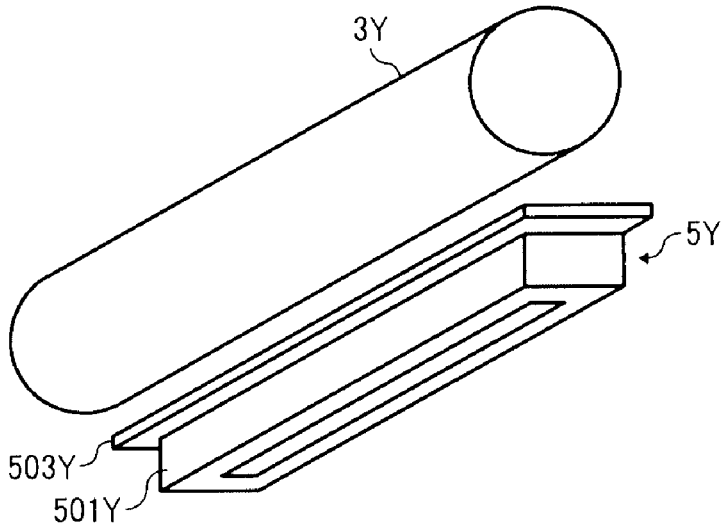
FIG. 5 is a perspective view of a charging device and a photoconductor included in the process unit shown in FIG. 3.
Figure 6:
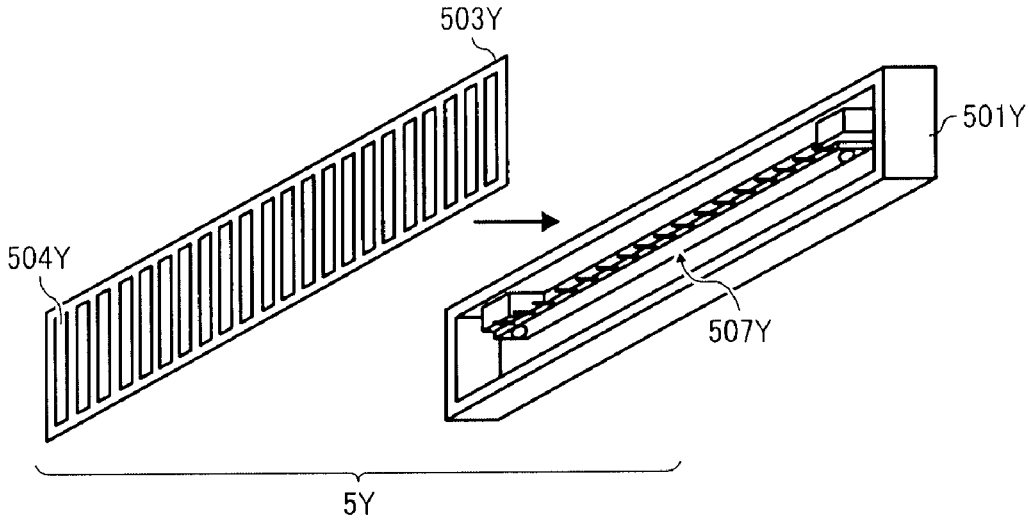
FIG. 6 is an exploded perspective view of the charging device shown in FIG. 5.
Figure 7:
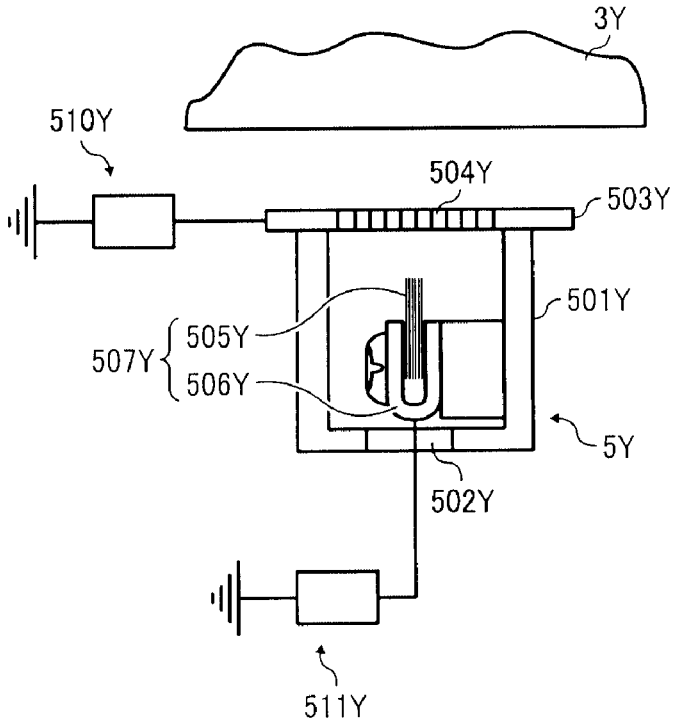
FIG. 7 is a schematic view of the charging device shown in FIG. 6.

Referring to FIGS. 5 to 7, a description is now given of characteristic features of the image forming apparatus 200 according to the exemplary embodiment. FIG. 5 is a perspective view of the charging device 5Y and the photoconductor 3Y. FIG. 6 is an exploded perspective view of the charging device 5Y. FIG. 7 is a schematic view of the charging device 5Y.

As illustrated in FIG. 5, the charging device 5Y is provided immediately below the photoconductor 3Y, and includes a casing 501Y and a grid electrode 503Y.

As illustrated in FIG. 6, the casing 501Y includes a charging brush 507Y. The grid electrode 503Y includes a plurality of openings 504Y.

As illustrated in FIG. 7, the charging device 5Y further includes a grid power source 510Y and a charging power source 511Y. The casing 501Y further includes a ventilation opening 502Y. The charging brush 507Y includes a brush 505Y and a metal holder 506Y.

The grid electrode 503Y is made of a metallic material such as stainless steel, copper, iron, and the like, so as to function as an electrode. The grid electrode 503Y also functions as a cover for covering a maintenance opening of the casing 501Y. Meanwhile, each of the plurality of openings 504Y of the grid electrode 503Y is slit-shaped, and exposes an inside of the casing 501Y.

As illustrated in FIG. 7, the casing 501Y opposes the photoconductor 3Y with the maintenance opening on which the grid electrode 503Y is fixed facing upwards, and is fixed to an inside of the body 80 (depicted in FIG. 1). The ventilation opening 502Y is provided in a bottom of the casing 501Y vertically facing downwards.

The charging brush 507Y is fixed to an inside of the casing 501Y. The brush 505Y includes a plurality of conductive fibers described below and stands on the metal holder 506Y. The metal holder 506Y, serving as a conductive holder, is screwed to the inside of the casing 501Y. The conductive fiber may include, but is not limited to, petroleum pitch carbon fiber including continuous fiber including acrylic fiber as synthetic fiber, PAN (polyacrylonitrile) series carbon fiber including coal tar, and metal fiber including stainless steel. Although there is no substantial difference between them in terms of how they function and the effect they achieve, compared to metal fiber, carbon fiber is more useful since it is available at a reduced cost, thereby decreasing manufacturing costs.

As illustrated in FIG. 7, the plurality of openings 504Y of the grid electrode 503Y opposes a top of the conductive fiber of the charging brush 507Y in the casing 501Y. The charging power source 511Y applies a charging bias having a polarity (e.g., a negative polarity) equal to a polarity of a uniformly charged potential of the photoconductor 3Y to the metal holder 506Y of the charging brush 507Y, while the grid power source 510Y applies a grid bias having a polarity equal to the polarity of the uniformly charged potential of the photoconductor 3Y and an absolute value smaller than that of the charging bias to the grid electrode 503Y. Then, electrical discharge occurs between the top of the conductive fiber of the charging brush 507Y and the photoconductor 3Y via the plurality of openings 504Y of the grid electrode 503Y serving as an electrode. As a result, the photoconductor 3Y is uniformly applied with the negative polarity.

Figure 8:
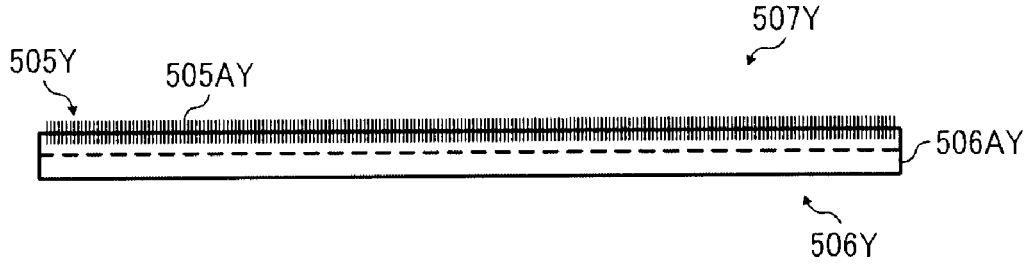
FIG. 8 is an exploded plan view of a charging brush included in the charging device shown in FIG. 6.
Figure 9:
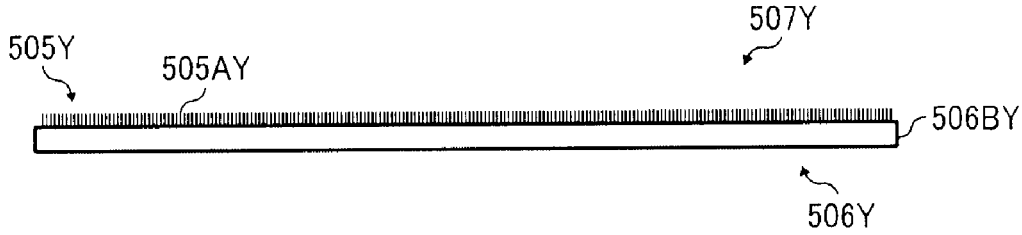
FIG. 9 is a plan view of the charging brush shown in FIG. 8.
Figure 10:
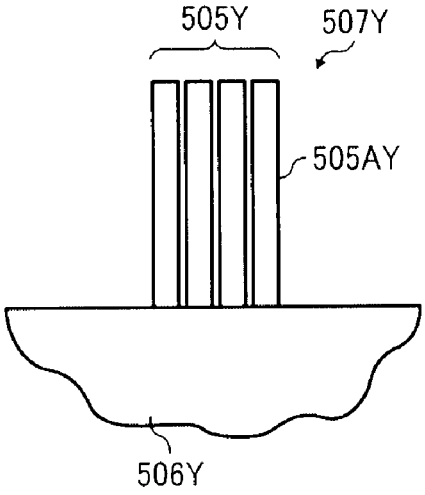
FIG. 10 is an enlarged view of the charging brush shown in FIG. 9 when no charging voltage is applied thereto.
Figure 11:
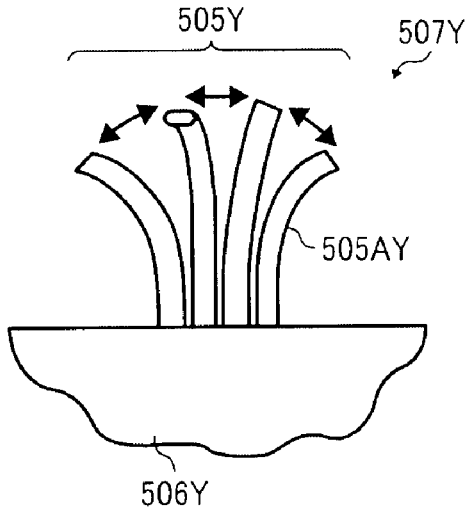
FIG. 11 is an enlarged view of the charging brush shown in FIG. 10 when a charging voltage is applied thereto.

Referring to FIGS. 8 to 11, a description is now given of a structure of the charging brush 507Y according to the exemplary embodiment. FIG. 8 is an exploded plan view of the charging brush 507Y, showing the metal holder 506Y of the charging brush 507Y including a first metal plate 506AY. FIG. 9 is a plan view of the charging brush 507Y, showing the metal holder 506Y of the charging brush 507Y further including a second metal plate 506BY. FIG. 10 is an enlarged view of the charging brush 507Y applied with no charging voltage. FIG. 11 is an enlarged view of the charging brush 507Y applied with a charging voltage. As illustrated in FIGS. 8 to 11, the brush 505Y of the charging brush 507Y includes a plurality of conductive fibers 505AY.

The plurality of conductive fibers 505AY of the brush 505Y of the charging brush 507Y is flexible, so as to bend in reaction to the electrical discharge from the top thereof. As illustrated in FIG. 8, the plurality of conductive fibers 505AY is planted in the first metal plate 506AY of the metal holder 506Y such that the top of the plurality of conductive fibers 505AY protrudes from a top surface of the metal plate 506Y. As illustrated in FIG. 9, a base of the plurality of conductive fibers 505AY is sandwiched between the first metal plate 506AY (depicted in FIG. 8) and the second metal plate 506BY, so that the plurality of conductive fibers 505AY is fixed to the metal holder 506Y.

According to the present exemplary embodiment, a pitch of the plurality of conductive fibers 505AY of the brush 505Y of the charging device 5Y in an axial direction of the photoconductor 3Y depicted in FIG. 7 (e.g., a longitudinal direction of the photoconductor 3Y) is smaller than a pitch of teeth of a charging device including a sawtooth discharging electrode. That is, a distance between points of discharge in the brush 505Y in the axial direction of the photoconductor 3Y is shorter than that in the charging device including the sawtooth discharging electrode. Therefore, compared to the charging device including the sawtooth discharging electrode, the charging device 5Y according to the present exemplary embodiment can more reliably charge the photoconductor 3Y uniformly. Additionally, as illustrated in FIG. 10, the plurality of conductive fibers 505AY of the brush 505Y is densely arranged to nearly contact each other. However, since application of a charging bias causes electrical charges to concentrate at the top of the conductive fibers 505AY, the plurality of flexible conductive fibers 505AY bends and separates from each other due to reaction force of the electrical charges, as illustrated in FIG. 11. Since electrical charges are independently concentrated at the top of each conductive fiber of the plurality of conductive fibers 505AY, electrical discharge occurs at a decreased voltage in each of the plurality of conductive fibers 505AY densely arranged. Therefore, according to the present exemplary embodiment, the charging device 5Y may uniformly charge the photoconductor 3Y with a charging bias lower than a charging bias applied in the charging device using the sawtooth discharging electrode.

The inventors conducted an experiment for uniformly charging the photoconductor 3Y using a prototype of the charging device 5Y. A distance from a top edge of conductive fibers 505AY to a grid electrode 503Y was set to 4 mm, and a distance from the grid electrode 503Y to the photoconductor 3Y was set to 2 mm. The conductive fibers 505AY included carbon fibers and had a diameter of 7 μm.

When a grid bias of −2 kV was applied to the grid electrode 503Y, and a charging bias of −3.2 kV was applied to the charging brush 507Y, so as to uniformly charge the photoconductor 3Y, corona discharge occurred at the top of each of the conductive fibers 505AY of the charging brush 507Y. As a result, the photoconductor 3Y was uniformly charged with a voltage of approximately −900 V.

By contrast, when a similar experiment using the above-described charging device including the sawtooth discharging electrode was performed, the photoconductor 3Y was not uniformly charged unless a charging bias of at least −4 kV was applied to the sawtooth discharging electrode.

Therefore, these experiments confirm that the charging device 5Y according to the present exemplary embodiment may uniformly charge the photoconductor 3Y at a voltage lower than the voltage applied in the charging device including the sawtooth discharging electrode. Moreover, such uniform charging of the photoconductor 3Y at a decreased voltage may reduce generation of ozone, nitrogen oxides, and sulphur oxides due to the corona discharge.

It is to be noted that charging characteristic was evaluated by measuring a surface potential of the photoconductor 3Y with a known electrostatic voltmeter before and after the photoconductor 3Y faces close to the charging brush 507Y and comparing both measurement values.

Figure 12:
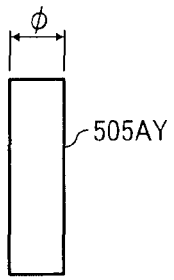
FIG. 12 is an enlarged view of a conductive fiber included in the charging brush shown in FIG. 11.

Referring to FIG. 12, a description is now given of a structure of the conductive fiber 505AY. FIG. 12 is an enlarged view of the conductive fiber 505AY of the brush 505Y of the charging brush 507Y (depicted in FIG. 7). The conductive fiber 505AY may preferably have a diameter of from about 0.1 μm to about 100 μm. More preferably, the conductive fiber 505AY may have a diameter of from about 0.1 μm to about 10 μm. A diameter exceeding 100 μm may reduce the flexibility of the conductive fiber 505AY.

The pitch of the conductive fiber 505AY of the brush 505Y in the axial direction of the photoconductor 3Y (depicted in FIG. 7) is preferably from about 10 fibers/mm to about 10,000 fibers/mm. The absolute value of charging voltage may be preferably set to from about 1 kV to about 4 kV. The conductive fiber 505AY also may preferably has a heat conductivity of from about $1.2\times10^4$ J/(m/h/K) to about $2.5\times10^4$ J/(m/h/K), thereby transmitting heat generated by discharge at the top of the conductive fiber 505AY quickly to the base thereof, and from there to the metal holder 506Y (depicted in FIG. 7). The metal holder 506Y may have a heat conductivity of from about $4.1\times10^7$ J/(m/h/K) to about $5.2\times10^8$ J/(m/h/K), and a heat capacity of from about 0.3 J/K to about 10 J/K, thereby drawing heat quickly from the conductive fiber 505AY to prevent a temperature increase of the conductive fiber 505AY, and also discharging the heat by storing it. Although according to the present exemplary embodiment the metal holder 506Y is a copper plate, alternatively it may be an aluminum plate or a stainless steel plate.

As illustrated in FIG. 7, although according to the present exemplary embodiment the grid electrode 503Y serving as an electrode includes the plurality of openings 504Y, alternatively it may include lattice-like openings or mesh-like openings.

The casing 501Y includes an insulating material such as an insulating resin, and functions as an insulating cover for covering all surfaces of the brush 505Y of the charging brush 507Y other than a top thereof opposing the grid electrode 503Y together with the metal holder 506Y. Therefore, an electromagnetic lines of force may be prevented from moving from the charging brush 507Y to the casing 501Y, or from moving from the grid electrode 503Y to the casing 501Y when the casing 501Y includes a conductive material. In particular, although use of the flexible conductive fibers 505AY may cause an electromagnetic lines of force to move toward the casing 501Y due to bending of the top of the conductive fibers 505AY at which the electrical charges are concentrated, use of the insulating material for the casing 501Y may prevent a failure of discharge due to a disordered electrical field caused by the movement of the electric lines of force, and generation of a charging failure of the photoconductor 3Y.

The insulating casing 501Y includes the ventilation opening 502Y for externally exposing an end of the metal holder 506Y, serving as a conductive holder, on a side opposite to the brush 505Y, thereby generating an airflow from the ventilation opening 502Y toward the rotating photoconductor 3Y through the inside of the casing 501Y and the openings 504Y so as to help charging from the top edges of the conductive fibers 505AY to the photoconductor 3Y. Further, toner particles are prevented from entering the casing 501Y, and thus do not adhere to the inside of the casing 501Y.

According to the present exemplary embodiment, the charging devices included in the process units 1C, 1M, and 1K have a structure equivalent to that of the charging device 5Y, and therefore redundant descriptions thereof are omitted hereinafter.

Another charging device includes a carbon nanotube for uniformly charging a photoconductor, and uses a method of emitting an electron from a hole with a diameter on the order of nanometers provided in the carbon nanotube supplied with a charging bias toward a photoconductor. However, in order to emit electrons from the holes in the carbon nanotube to the photoconductor, the carbon nanotube and the photoconductor need to be placed under reduced pressure equivalent to a vacuum. Since pressure inside an image forming apparatus for feeding recording sheets can hardly be reduced, the foregoing method may not be practical. Moreover, even when electrons are emitted from the holes in the carbon nanotube, toner particles may scatter inside the image forming apparatus and clog the holes. As a result, stable charging performance may not be maintained.

Figure 13:
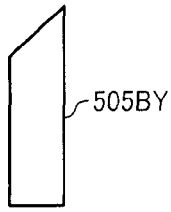
FIG. 13 is an enlarged view of a conductive fiber according to another exemplary embodiment.

FIG. 13 is an enlarged view of a conductive fiber 505BY of the charging brush 507Y of the charging device 5Y of the image forming apparatus 200 according to another exemplary embodiment. The conductive fiber 505BY includes a tapered top formed by an oblique cutting process or a grinding process. Since a larger amount of electrical charges is concentrated at the top of the conductive fiber 505BY than in the conductive fiber 505AY (depicted in FIG. 12), corona discharge may occur at a lower charging voltage. The conductive fiber 505BY may be of a material and a size equivalent to those of the conductive fiber 505AY. Also, conditions for charging voltage in the conductive fiber 505BY may be equal to those in the above-described exemplary embodiment.

Figure 14:
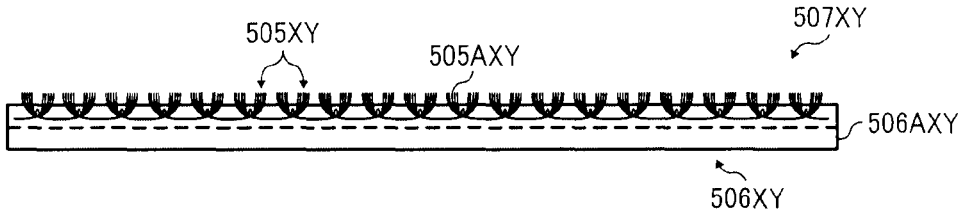
FIG. 14 is an exploded plan view of a charging brush according to yet another exemplary embodiment.
Figure 15:
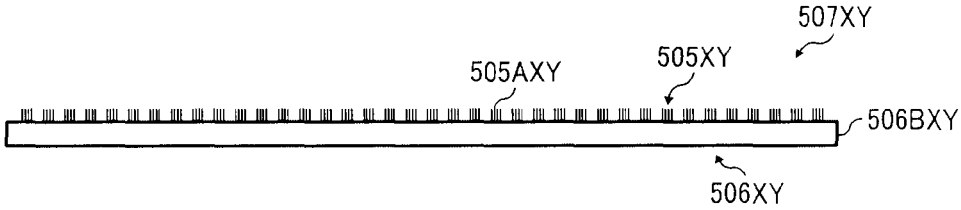
FIG. 15 is a plan view of the charging brush shown in FIG. 14.

FIG. 14 is an exploded plan view of a charging brush 507XY of the charging device 5Y of the image forming apparatus 200 according to yet another exemplary embodiment. FIG. 15 is a plan view of the charging brush 507XY.

As illustrated in FIGS. 14 and 15, the charging brush 507XY includes a plurality of brushes 505XY and a metal holder 506XY. The plurality of brushes 505XY includes a plurality of conductive fibers 505AXY. The metal holder 506XY includes a first metal plate 506AXY and a second metal plate 506BXY.

As illustrated in FIG. 14, unlike the plurality of conductive fibers 505AY (depicted in FIGS. 8 and 9) evenly provided in a longitudinal direction of the brush 505Y (e.g., the longitudinal direction of the photoconductor 3Y depicted in FIG. 7), the plurality of conductive fibers 505AXY is relatively short and is provided in a longitudinal direction of the charging brush 507XY at a predetermined pitch. A base of each of the plurality of conductive fibers 505AXY is tied into a bundle by itself and fixed to the first metal plate 506AXY. As illustrated in FIG. 15, the base of the plurality of conductive fibers 505AXY is sandwiched between the first metal plate 506AXY (depicted in FIG. 14) and the second metal plate 506BXY, so that the plurality of conductive fibers 505AXY is fixed to the metal holder 506XY. According to the present exemplary embodiment, compared to the charging brush 507Y including the plurality of conductive fibers 505AY separately fixed to the metal holder 506Y, the plurality of conductive fibers 505AXY may be more securely prevented from falling out of the brush 505XY.

Figure 16:
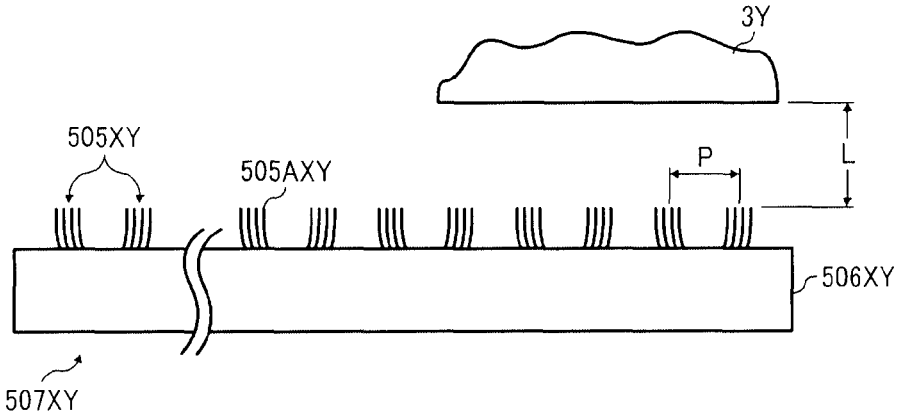
FIG. 16 is an enlarged view of the charging brush shown in FIG. 15.

FIG. 16 is an enlarged schematic view of the charging brush 507XY and the photoconductor 3Y. A relation between a distance L from a top edge of the conductive fiber 505AXY of the brush 505XY to the photoconductor 3Y and a pitch P of the plurality of brushes 505XY in the longitudinal direction of the charging brush 507XY is represented by P≦L. More specifically, the pitch P is set to be equal to the distance L, or smaller than the distance L by several percent. According to the present exemplary embodiment, uniform charging of the photoconductor 3Y due to an excessive large arrangement pitch of the brushes 505XY can be more reliably conducted.

Structures of charging brushes included in the process units 1C, 1M, and 1K are equivalent to that of the charging brush 507XY, and therefore redundant descriptions thereof are omitted hereinafter.

Referring to FIGS. 17 to 22, a description is now given of a structure of a charging device 5YA of the image forming apparatus 200 according to yet another exemplary embodiment.

Figure 17:
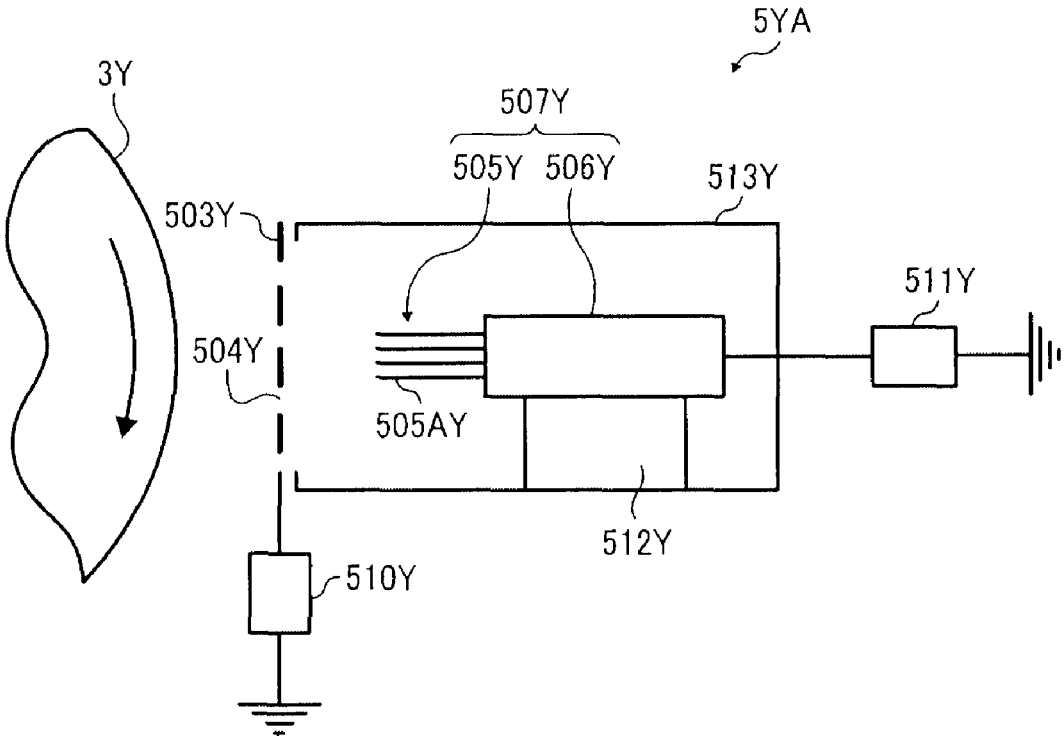
FIG. 17 is a schematic view of a charging device according to yet another exemplary embodiment.

FIG. 17 is a schematic view of the charging device 5YA. The charging device 5YA includes a spacer 512Y and a casing 513Y. The other elements of the charging device 5YA are common to the charging device 5Y depicted in FIG. 7.

The plurality of conductive fibers 505AY of the brush 505Y may include a carbon fiber, a conductive acrylic fiber (e.g., SA-7), and a copper sulfide mixed fiber (e.g., thunderon (registered trademark)).

Unlike the casing 501Y (depicted in FIG. 7) according to the above-described exemplary embodiment, the casing 513Y includes metal such as aluminum and stainless. The spacer 512Y includes an insulating material. The metal holder 506Y of the charging brush 507Y is fixed to an inner wall of the casing 513 via the spacer 512Y with a screw or the like.

A top edge of the plurality of conductive fibers 505AY of the brush 505Y faces a surface of the photoconductor 3Y over a predetermined distance (a gap). A large opening is provided in a surface of the casing 513Y opposing the photoconductor 3Y. The grid electrode 503Y is fixed to the casing 513Y so as to cover the opening. Therefore, the grid electrode 503Y is provided between the top edge of the plurality of conductive fibers 505AY of the brush 505Y and the photoconductor 3Y. Additionally, an insulator, not shown, is disposed between the grid electrode 503Y and the casing 513Y, thereby providing an insulation property therebetween.

Figure 18:
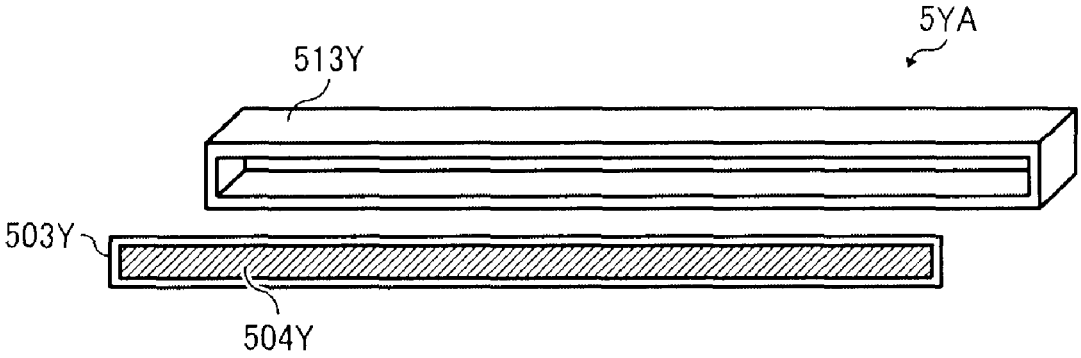
FIG. 18 is an exploded perspective view of the charging device shown in FIG. 17.

FIG. 18 is an exploded perspective view of the charging device 5YA. The grid electrode 503Y includes a thin metal plate including stainless, copper, and iron. The plurality of openings 504Y is formed in the grid electrode 503Y by etching or the like, and each opening has an oblique slit-like shape or a lattice-like shape.

Figure 19:
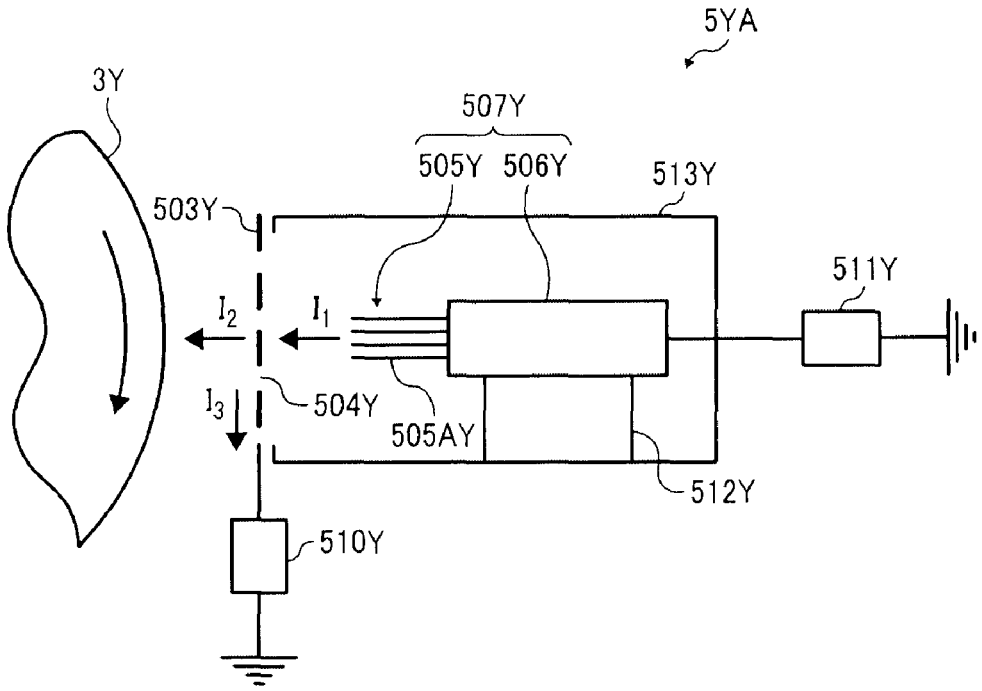
FIG. 19 is a schematic view of the charging device shown in FIG. 17 illustrating a flow of an electrical current.

FIG. 19 illustrates a flow of an electrical current in the charging device 5YA. As described above, the charging power source 511Y applies a charging bias having a polarity (e.g., a negative polarity) equal to a polarity of a uniformly charged potential of the photoconductor 3Y to the metal holder 506Y of the charging brush 507Y. The grid power source 510Y applies a grid bias having a polarity equal to the polarity of the uniformly charged potential of the photoconductor 3Y and an absolute value smaller than that of the charging bias to the grid electrode 503Y. Then, electrical discharge occurs between the top edge of the conductive fibers 505AY of the charging brush 507Y and the photoconductor 3Y via the plurality of openings 504Y of the grid electrode 503Y, producing brush currents $I_1$, $I_2$, and $I_3$ as illustrated in FIG. 19. The electrical discharge causes the surface of the photoconductor 3Y to be supplied with electrons or ions and uniformly charged.

The inventors conducted an experiment for measuring a discharge effect using a prototype of the charging device 5YA. Specifically, a constant-current power supply including a constant current control circuit capable of constantly controlling an output current was used as the charging power source 511Y. In addition, a constant-voltage power supply including a constant voltage control circuit capable of constantly controlling an output voltage was used as the grid power source 510Y. Carbon fiber with a diameter of 7 μm was used for the plurality of conductive fibers 505AY of the brush 505Y. A distance between the grid electrode 503Y and the photoconductor 3Y was set to 1.5 mm.

The charging power source 511Y applied a charging voltage to the brush 505Y so as to produce the brush current $I_1$ of 80 μA through the brush 505Y, while the grid power source 510Y applied a predetermined grid voltage to the grid electrode 503Y. The grid current $I_2$ flowing from the brush 505Y to the grid electrode 503Y via a space between the brush 505Y and the grid electrode 503Y was measured using a multi-ammeter. A discharge effect E was obtained based on the measurement result and a following formula (1):

$$E=(I_1-I_2)/I_1\times 100 \quad (1)$$

where E represents a discharge effect in percent, $I_1$ represents a brush current, and $I_2$ represents a grid current.

Figure 20:
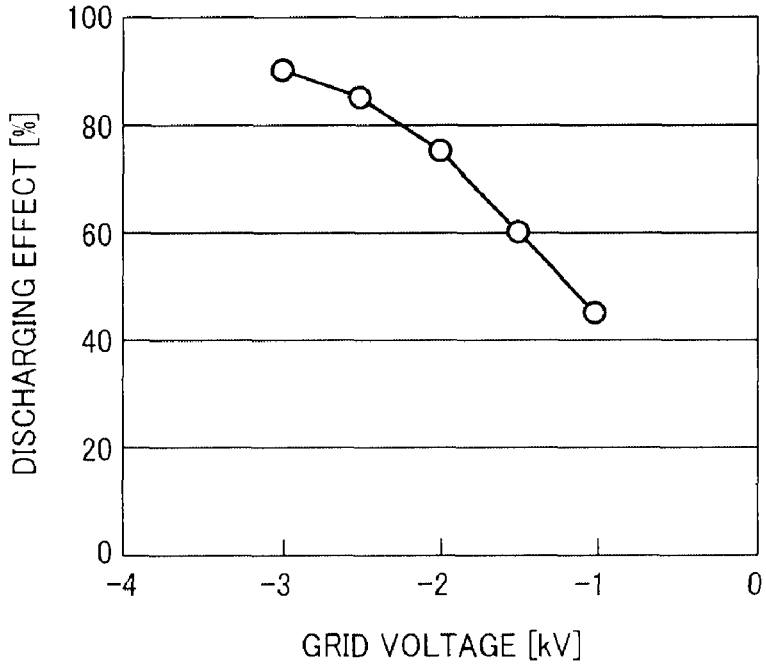
FIG. 20 is a graph illustrating a relation between a discharging effect and a grid voltage.

FIG. 20 is a graph illustrating a relation between the discharging effect and the grid voltage obtained in the above-described experiment. The graph shows that application of a grid voltage of −2.5 kV or smaller can produce a discharge effect of 80% or larger.

When a surface potential of the photoconductor 3Y was measured by using a surface electrostatic voltmeter, specifically a Model 344 electrostatic voltmeter manufactured by TREK, INC., the photoconductor 3Y was charged with a desired potential by adjusting the grid voltage. Even when the photoconductor 3Y was charged under conditions designed to produce a discharging effect of about 50% in order to prevent nonuniform charging of the photoconductor 3Y, the charging device 5YA may generate an amount of ozone smaller than an amount of ozone generated by a conventional scorotron charging device.

Figure 21:
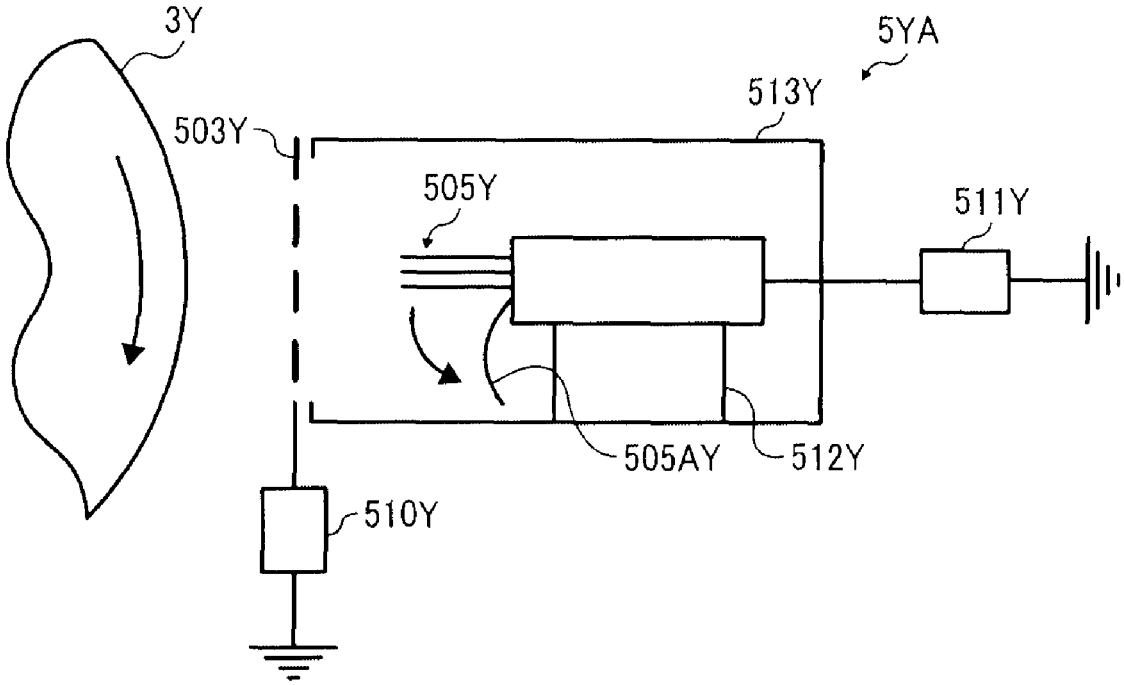
FIG. 21 is a schematic view of the charging device shown in FIG. 17 illustrating an occurrence of abnormal discharge due to bending of a conductive fiber.

When the plurality of conductive fibers 505AY of the brush 505Y is supplied with a charging bias, a conductive fiber 505AY bends and slightly separates from adjacent conductive fiber 505AY as illustrated in FIG. 11. However, as illustrated in FIG. 21, when the conductive fiber 505AY tends to bend substantially after being bent inadvertently during assembly of the charging brush 507Y (depicted in FIG. 19) or the like, the top of the conductive fiber 505AY comes close to the inner wall of the metal casing 513Y, thus generating undesirable discharge (e.g., abnormal discharge) between the top of the conductive fiber 505AY and the metal casing 513Y.

Therefore, a distance between the base of the conductive fiber 505AY of the brush 505Y provided inside the casing 513Y and the inner wall of the casing 513Y is set to be longer than a distance obtained by adding a length of the conductive fiber 505AY to a distance between the conductive fiber 505AY supplied with a charging bias and the inner wall of the casing 513Y.

Figure 22:
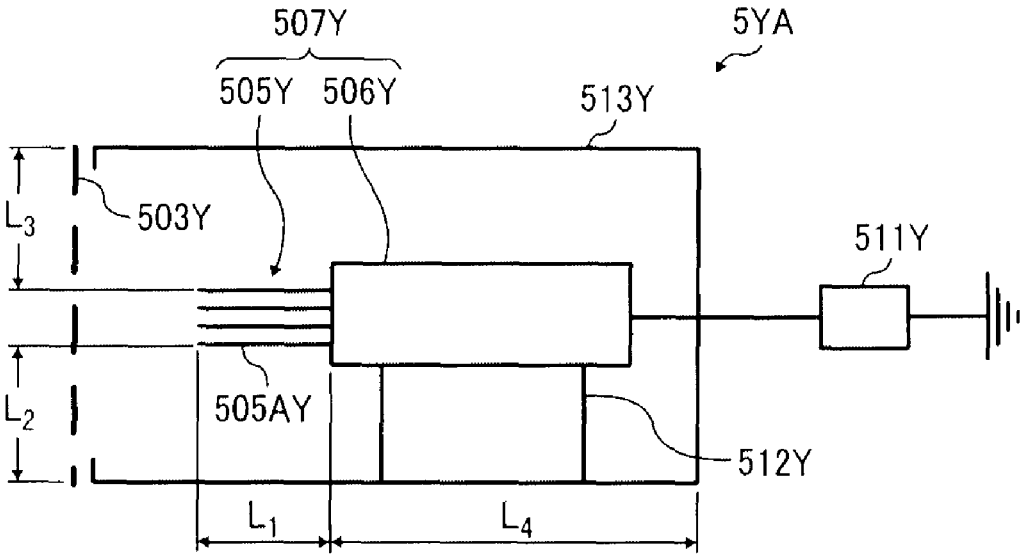
FIG. 22 is a schematic view of the charging device shown in FIG. 17 illustrating a distance between a conductive fiber and a cover.

To be specific, as illustrated in FIG. 22, L1 shows a distance from the top edge of the plurality of conductive fibers 505AY to the base thereof fixed to the metal holder 506Y. The casing 513Y for covering the charging brush 507Y includes four side plates opposing the conductive fibers 505AY and extending in a longitudinal direction of the conductive fibers 505AY and a base plate opposing the grid electrode 503Y via the charging brush 507Y. L2 shows a distance between a first side plate, which is one of the four side plates, and a base of one of the plurality of conductive fibers 505AY that is closest to the first side plate. L3 shows a distance between a second side plate, which is another one of the four side plates, and a base of another one of the plurality of conductive fibers 505AY that is closest to the second side plate. L4 shows a distance between the base plate and the bases of the conductive fibers 505AY. L5, not shown, indicates a distance between a third side plate, not shown, and a base of yet another one of the plurality of conductive fibers 505AY that is closest to the third side plate. L6, not shown, indicates a distance between a fourth side plate, not shown, and a base of yet another one of the plurality of conductive fibers 505AY that is closest to the fourth side plate.

When the charging brush 507Y supplied with a charging bias is moved in the casing 513Y to a position at which a predetermined distance is provided between the charging brush 507Y and the inner wall of the casing 513Y, electrical discharges start to be generated between the top edge of the conductive fiber 505AY and the inner wall of the casing 513Y. The above distance indicates a discharge starting distance L7 between the conductive fibers 505AY and the inner wall of the casing 513Y.

According to the present exemplary embodiment, the distances L2, L3, L4, L5, and L6, all of which indicate the distances between the base of the conductive fibers 505AY and the inner wall of the casing 513Y, are set to be longer than a distance obtained by adding the distance L1 (e.g., the length) of the conductive fibers 505AY to the discharge starting distance L7. Therefore, even if the conductive fiber 505AY substantially bends such that the top edge of the conductive fiber 505AY comes as close to the inner wall of the casing 513Y as possible, the distance between the top edge of the conductive fiber 505AY and the inner wall of the casing 513Y may be kept longer than the discharge starting distance L7, thereby preventing generation of abnormal discharge therebetween.

According to the present exemplary embodiment, the casing 513Y may include a metal material stiffer than an insulating material such as resin or the like, so as to improve structural strength of the charging device 5YA and prevent abnormal discharge between the top edge of the conductive fiber 505AY and the inner wall of the casing 513Y. Further, such prevention of abnormal discharge may lengthen the useful life of the brush 505Y, thereby maintaining stable discharge performance for an extended period of time. Additionally, when abnormal discharge occurs, electrons or ions move from the brush 505Y to the casing 513Y to ground and are thus wasted without being used for charging of the photoconductor 3Y. Accordingly, prevention of abnormal discharge may prevent such wasteful power consumption.

When a constant-voltage power supply is used as the charging power source 511Y, a discharge starting distance L7 is measured by applying a charging voltage of a bias value controlled to be constant by the constant-voltage power supply to the brush 505Y. When a constant-voltage power supply for correcting a bias control value according to environmental changes is used, a discharge starting distance L7 is measured by applying an upper limit of charging voltage to the brush 505Y. When a constant-voltage power supply for correcting a bias control value according to environmental changes without setting upper and lower limits to a correction value is used, a discharge starting distance L7 is measured by applying a charging bias of the maximum output value, which is a designed value, to the brush 505Y. When a constant-voltage power supply for supplying a charging voltage having an upper limit is used, a discharge starting distance L7 is measured by applying a charging voltage of the upper limit to the brush 505Y. When a constant-voltage power supply for supplying a charging voltage having no upper limit is used, a discharge starting distance L7 is measured by applying a charging bias of the maximum output value, which is a designed value, to the brush 505Y.

Figure 23:
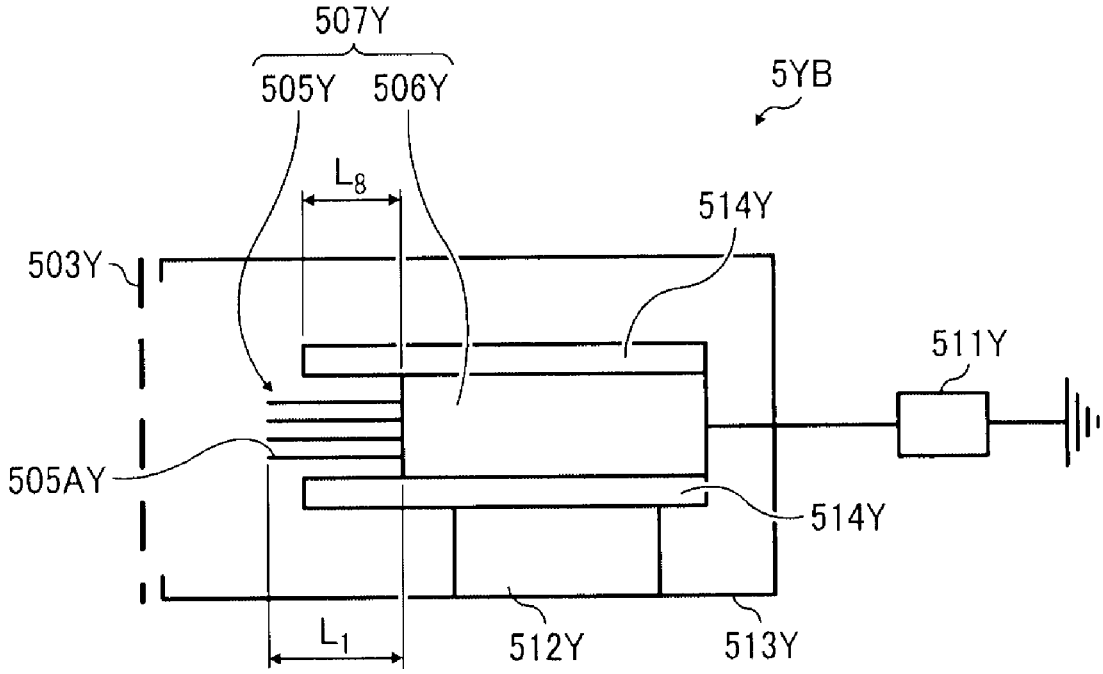
FIG. 23 is a schematic view of a charging device according to yet another exemplary embodiment.
Figure 24:
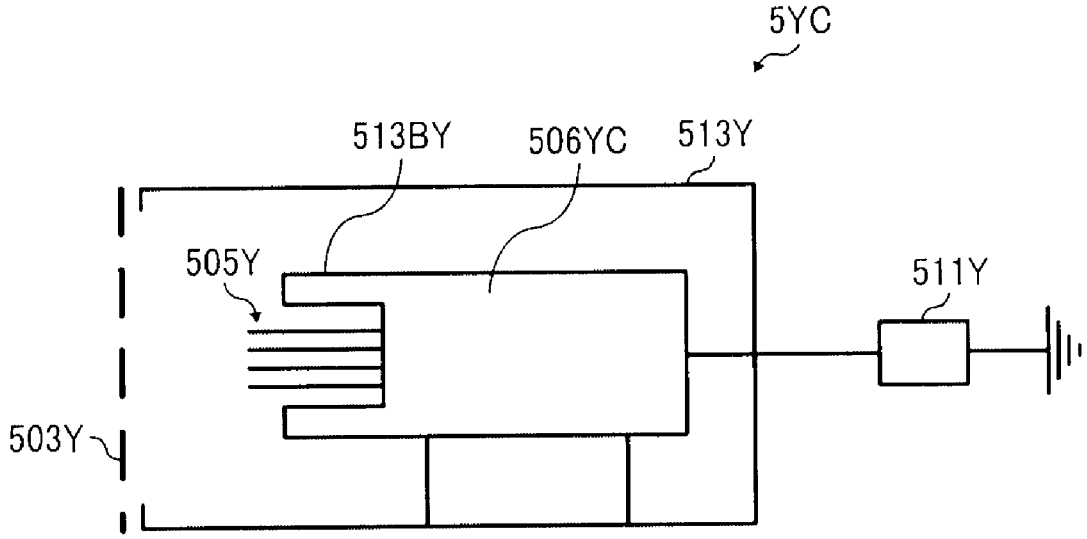
FIG. 24 is a schematic view of a charging device according to yet another exemplary embodiment.

Referring to FIGS. 23 and 24, a description is now given of charging devices 5YB and 5YC of the image forming apparatus 200 according to yet another exemplary embodiment.

FIG. 23 is a schematic view of a charging device 5YB. The charging device 5YB includes blocking members 514Y. The other elements of the charging device 5YB are common to the charging device 5YA depicted in FIG. 22.

Like the casing 513Y of the charging device 5YA (depicted in FIG. 17), the casing 513Y of the charging device 5YB also include a metal material. The metal holder 506Y has a rectangular parallelepiped shape (e.g., a box-like shape) with six surfaces. The brush 505Y is fixed to a fixing surface, that is, one surface of the six surfaces thereof. Four blocking members 514Y are fixed to four side surfaces adjacent to four sides of the fixing surface on which the brush 505Y is fixed, respectively. Each of the blocking members 514Y includes an insulating material and has a plate-like shape. Each of the blocking members 514Y is fixed to the side surface of the metal holder 506Y in such a manner that the blocking member 514Y protrudes from the fixing surface, on which the brush 505Y is fixed toward the top of the brush 505Y for a length L8.

When the conductive fibers 505AY of the brush 505Y are supplied with a charging bias, a conductive fiber 505AY bends and is slightly separated from adjacent conductive fibers 505AY. However, even when an operator, a service engineer, or the like inadvertently touches the brush 505Y and the conductive fiber 505AY bends excessively in any direction, the conductive fiber 505AY hits a protruding portion of one of the four blocking members 514Y protruding from the fixing surface on which the brush 505Y is fixed, thus preventing such excessive bending of the conductive fiber 505AY.

According to the present exemplary embodiment, the casing 513Y may include a metal material stiffer than an insulating material such as resin, or the like, so as to improve structural strength of the charging device 5Y and prevent abnormal discharge between the top edge of the conductive fiber 505AY and the inner wall of the casing 513Y. Further, such prevention of abnormal discharge may lengthen the useful life of the brush 505Y, thereby maintaining stable discharge performance for an extended period of time. Additionally, prevention of such abnormal discharge may avoid wasteful power consumption.

The length L8 of the protruding portion of the blocking member 514Y may preferably be set shorter than the distance L1 (e.g., the length) of the conductive fiber 505AY, such that the protruding portion of the blocking member 514Y protruding from the fixing surface of the metal holder 506Y on which the conductive fiber 505AY is fixed does not protrude beyond the top of the brush 505Y. Therefore, since the blocking member 514Y having an insulating property is not closer to the grid electrode 503Y than the top edge of the conductive fiber 505AY, decrease in strength of an electrical field between the top edge of the conductive fiber 505AY and the grid electrode 503Y may be prevented. Accordingly, an increase in charging bias due to a decrease in the strength of the electrical field may be prevented.

As illustrated in FIG. 23, four blocking members 514Y may be provided to surround the brush 505Y except for areas opposing the top edge of the brush 505Y and the base of the brush 505Y, thereby preventing excessive bending of the conductive fiber 505AY in any direction. However, an arrangement of the blocking members 514Y is not limited to an arrangement thereof as illustrated in FIG. 23, that is, not all of the blocking members 514 may be provided. For example, one blocking member 514Y may be provided on one side of the brush 505Y to prevent the conductive fiber 505AY from bending in a direction in which the blocking member 514Y is provided.

The blocking member 514Y may be softer than the conductive fiber 505AY so as not to damage the conductive fiber 505AY, so that abnormal discharge due to excessive bending of the conductive fiber 505AY may be prevented.

A top edge of the protruding portion of the blocking member 514Y may preferably be chamfered or R-chamfered, thereby preventing the conductive fiber 505AY from being snagged by the top edge of the blocking member 514Y.

The blocking member 514Y may preferably have a flexural rigidity greater than that of the conductive fiber 505AY, thereby preventing bending of the blocking member 514Y caused by hitting of the conductive fiber 505AY, and thus excessive bending of the conductive fiber 505AY may be prevented. As described above, when the blocking member 514Y is softer than the conductive fiber 505AY so as to prevent damage to the conductive fiber 505AY, the blocking member 514Y may lack flexural rigidity. To address this problem, the blocking member 514Y may be folded into a complicated shape such as an emboss-like shape or a rib-like shape, thereby increasing its flexural rigidity.

The blocking member 514Y may include an ozone-resistant base material such as chromium-nickel stainless steel having increased oxidation resistance and nonoxidation resistance, stainless steel SUS316L including nickel, stainless steel SUS316 including copper, alumite-treated aluminum, fluorocarbon polymer (e.g., ethylene resin tetrafluoride), and the like. Therefore, degradation of the blocking member 514Y due to ozone caused by discharge from the conductive fiber 505AY may be prevented. When a conductive material is used as the base material of the blocking member 514Y, it may preferably include an insulating surface.

Further, the base material of the blocking member 514Y may preferably have increased heat conductivity, for example, from about 80 W/(m·K) to about 420 W/(m·K). Therefore, heat generated by discharge may be quickly absorbed, and quickly transmitted to the metal holder 506Y, thereby preventing a temperature increase around the top of the brush 505Y.

FIG. 24 is a schematic view of the charging device 5YC. The charging device 5YC includes a metal holder 506YC and a blocking member 513BY. The other elements of the charging device 5YC are common to the charging device 5YA depicted in FIG. 22.

The blocking member 513BY protrudes from a circumferential edge of a fixing surface of the metal holder 506YC, to which the brush 505Y is fixed, toward the top of the brush 505Y. The blocking member 513BY is integrated with the metal holder 506YC. Namely, the blocking member 514Y (depicted in FIG. 23) is integrated into the metal holder 506YC, so that the number of components and manufacturing processes may be reduced.

As in the charging device 5YA (depicted in FIGS. 17, 19, and 22), provision of the large distance between the conductive fibers 505AY and the casing 513Y may prevent generation of abnormal discharge, however, may cause enlargement of the charging device 5YA instead. Also, as in the charging device 5YB (depicted in FIG. 23) or the charging device 5YC (depicted in FIG. 24), provision of the blocking member 514Y or the blocking member 513BY may prevent generation of abnormal discharge, however, provision of an installation space in the casing 513Y may cause enlargement of the charging device 5YB or the charging device 5YC.

A method (e.g., a brush-grid method) in which the grid electrode 503Y and the charging brush 507Y are provided provides an increased charging effect of from about 80% to about 90% depending on conditions, represented by a ratio between an electrical current flowing out from the brush 505Y and an electrical current flowing into the photoconductor 3Y.

Figure 25:
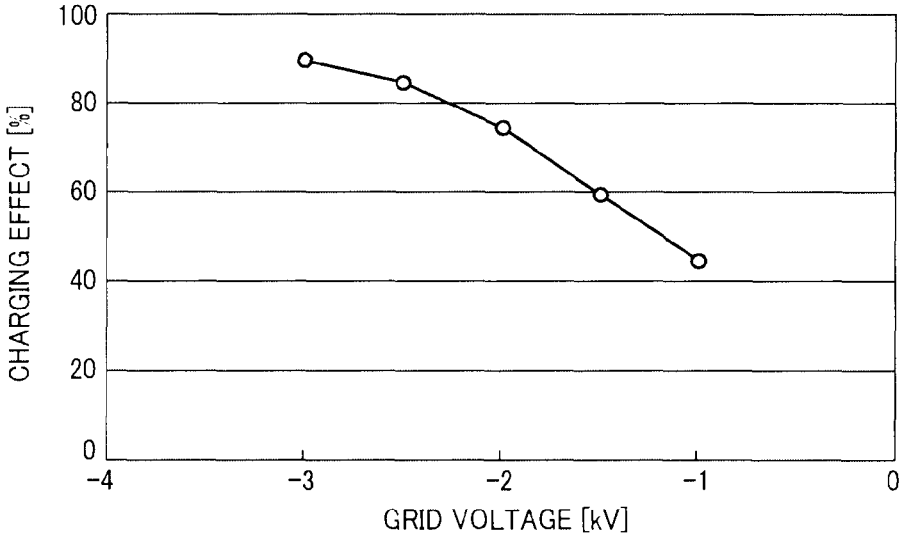
FIG. 25 is a graph illustrating a relation between a charging effect and a grid voltage.

FIG. 25 is a graph illustrating a result of an experiment for examining a relationship between a charging effect and a grid bias (e.g., a grid voltage). By applying a grid voltage above −2.5 kV, a charging effect of 80% or larger may be obtained. Even when the grid electrode 503Y and the charging brush 507Y are provided the image forming apparatus 200, a charging effect of about 50% may be expected. Compared to a conventional wire method including a corotron or a scorotron providing a charging effect of about 10%, the brush-grid method may efficiently perform a charging process. For example, in a case of flowing an electrical current of 100 μA from the brush 505Y to the photoconductor 3Y, the wire method needs to supply an electrical current of about 1 mA to the brush 505Y, but the brush-grid method needs merely about 200 μA. That is, reduction of about 80% of electrical power may be achieved. However, once abnormal discharge generates, the generation of abnormal discharge may decrease the power reduction effect substantially.

Figure 26:
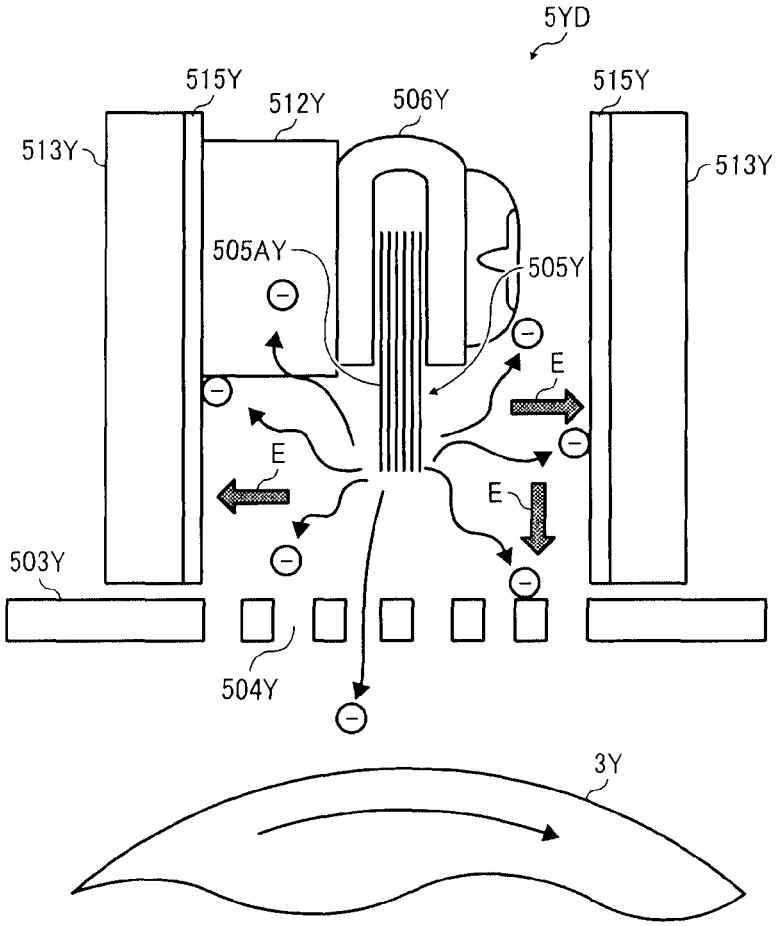
FIG. 26 is a schematic view of a charging device according to yet another exemplary embodiment.

FIG. 26 is a schematic view of a charging device 5YD of the image forming apparatus 200 according to yet another exemplary embodiment. The charging device 5YD includes insulating films 515Y. The other elements of the charging device 5YD are common to the charging device 5YA depicted in FIG. 17.

The insulating films 515Y, serving as a directionality improvement member, is provided inside the casing 513Y and improves discharging directivity from the top of the conductive fiber 505AY to the grid electrode 503Y. Improvement of discharging directivity may prevent generation of abnormal discharge between the conductive fibers 505AY and the inner wall of the casing 513Y. Therefore, while preventing enlargement of the charging device 5YD due to provision of the large distance between the conductive fibers 505AY and the inner wall of the casing 513Y, or provision of the blocking member 514Y (depicted in FIG. 23) or 513BY (depicted in FIG. 24), a waste of power consumption due to abnormal discharge may be prevented.

The insulating films 515Y, serving as a directionality improvement member, includes an electrical charge holder for providing the inner wall of the casing 513Y of the charging device 5YD with an electrical charge with a polarity equal to that of a charging bias. When the inner wall of the casing 513Y of the charging device 5YD is supplied with an electrical charge with a polarity equal to that of a charging bias to reduce a potential difference between the conductive fibers 505AY and the inner wall of the casing 513Y, electrical discharge may not easily generate between the conductive fibers 505AY and the inner wall of the casing 513Y, and thereby the directivity of discharging from the top of the conductive fiber 505AY to the grid electrode 503Y may be improved.

Figure 27:
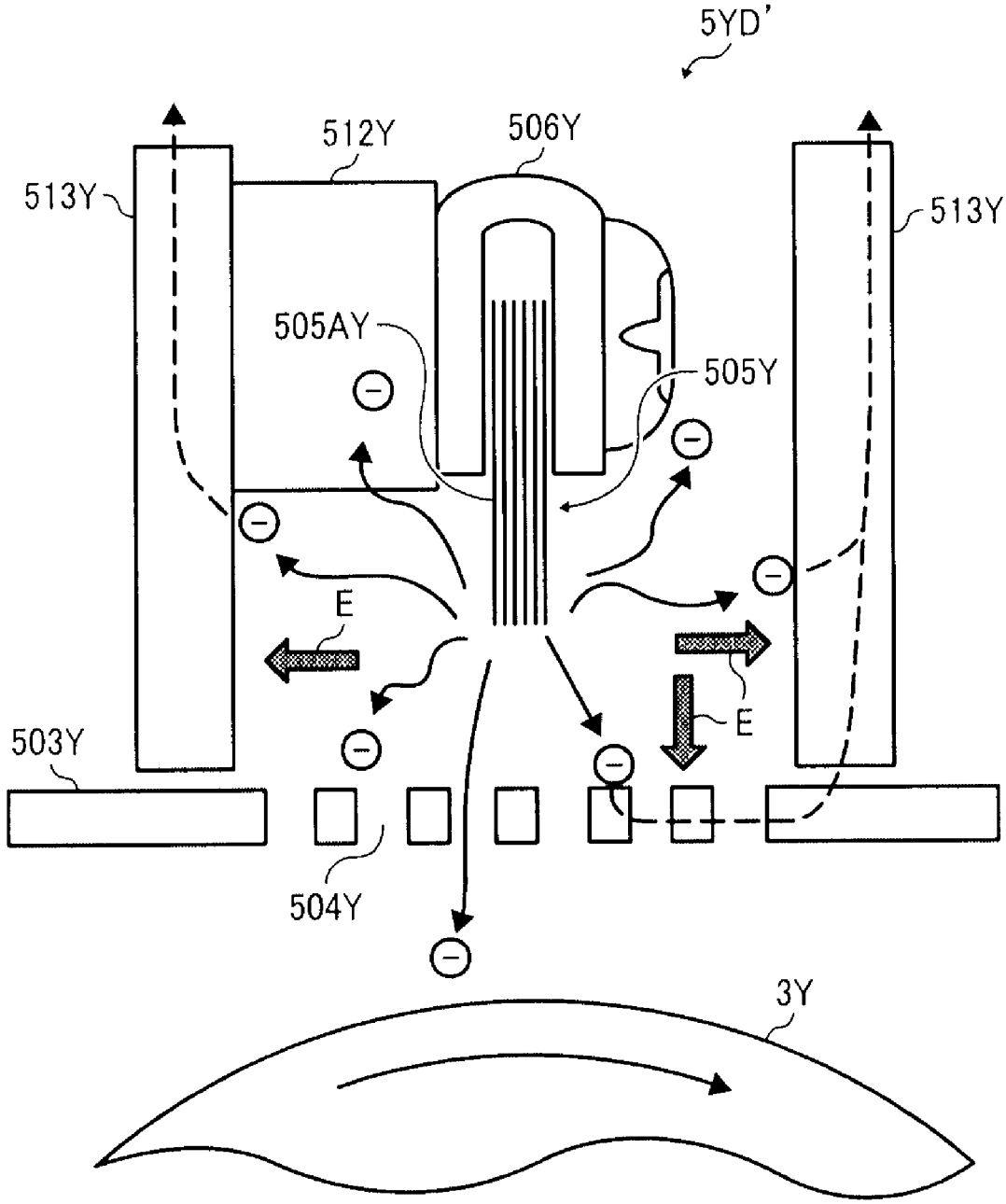
FIG. 27 is a schematic view of a charging device not including a directionality improvement member included in the charging device shown in FIG. 26.

FIG. 27 is a schematic view of a charging device 5YD' using a brush-grid method, which does not include the insulating films 515Y depicted in FIG. 26. The other elements of the charging device 5YD' are common to the charging device 5YD depicted in FIG. 26. Like the charging devices 5YA (depicted in FIG. 17), 5YB (depicted in FIG. 23), and 5YC (depicted in FIG. 24) according to the above exemplary embodiments, the charging device 5YD' includes the metal casing 513Y, serving as a cover. However, in order to downsize the charging device 5YD', the charging device 5YD' does not include a large distance between the conductive fibers 505AY and the casing 513Y, nor include the blocking member 514Y (depicted in FIG. 23) and 513BY (depicted in FIG. 24). When the brush 505Y is supplied with a charging bias, and the gird electrode 503Y is applied with a grid bias, such that a potential difference of about 2.5 kV is applied between the brush 505Y and the grid electrode 503Y, electrical discharge occurs between the top of the conductive fiber 505AY and the gird electrode 503Y to discharge electrons from the conductive fiber 505AY toward the gird electrode 503Y. Some of the discharged electrons move to the surface of the grid electrode 503Y, while most of the electrons are attracted to an electrical field formed between the grid electrode 503Y and the photoconductor 3Y, pass through the openings 504Y, and transfer to the surface of the photoconductor 3Y.

Unlike this type of discharge, abnormal discharge irregularly occurs between the conductive fiber 505AY and the casing 513Y connected to a ground. The abnormal discharge causes an electron to move from the conductive fiber 505AY to the inner wall of the casing 513Y and flow to the ground via a ground wire, not shown, thereby causing a waste of power consumption.

As illustrated in FIG. 26, the charging device 5YD also includes the metal casing 513Y, serving as a cover. However, in order to downsize the charging device 5YD, the charging device 5YD does not include a large distance between the conductive fibers 505AY and the casing 513Y nor include the blocking member 514Y (depicted in FIG. 23) and the blocking member 513BY (depicted in FIG. 24).

The insulating film 515Y is formed in the inner wall of the metal casing 513Y, and includes an insulating tape (e.g., Teflon (trademark) tape). An electrical field is formed between the conductive fiber 505AY and the metal casing 513Y via the insulating film 515Y. When electrical discharge occurs between the conductive fiber 505AY and the casing 513Y, electrons discharged from the conductive fiber 505AY transfer to a surface of the insulating film 515Y in a direction of the electrical field and remain thereon for an extended period of time of time without flowing into the casing 513Y. As an amount of electrons on the surface of the insulating film 515Y gradually increases according to abnormal discharge, an electric potential of the surface of the insulating film 515Y gradually becomes negative, so that a electric potential difference between the insulating film 515Y and the conductive fiber 505AY gradually becomes small, thereby improving discharging directivity from the top of the conductive fiber 505AY to the grid electrode 503Y.

According to the present exemplary embodiment, improvement of discharging directivity from the top of the conductive fiber 505AY to the grid electrode 503Y may decrease an amount of abnormal discharge. In addition, since the electrons generated by the abnormal discharge remain on the surface of the insulating film 515Y to improve the discharging directivity, a waste of power consumption may be prevented.

Figure 28:
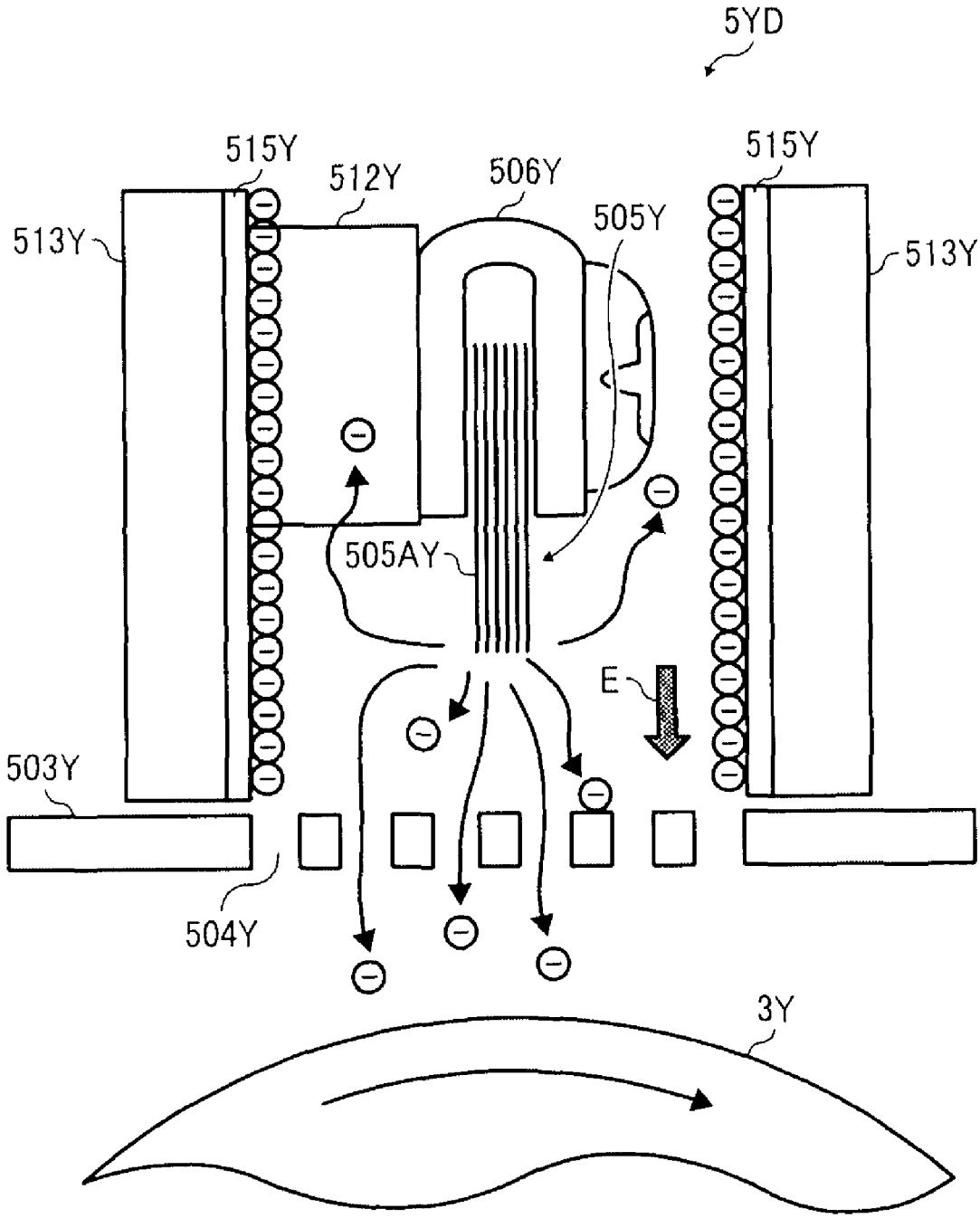
FIG. 28 is a schematic view of the charging device shown in FIG. 26 illustrating a large amount of electrons kept on the directionality improvement member.

FIG. 28 is another schematic view of the charging device 5YD. When the charging device 5YD is often activated, a large amount of electrons may be kept on the surface of the insulating film 515Y, thereby almost eliminating the electric potential difference between the insulating film 515Y and the conductive fiber 505AY. In this case, since no electrical field moves from the conductive fiber 505AY to the insulating film 515Y, most of the electrons discharged from the conductive fiber 505AY may transfer to the photoconductor 3Y.

Although the casing 513Y, serving as a cover, includes a metal material according to the present exemplary embodiment, the casing 513Y including an insulating material also may include the insulating film 515Y, serving as directionality improvement member. In this case, a metal layer including a metal plate and a metal sheet may be provided on an outer wall of the insulating casing 513Y, and connected to a ground. Accordingly, an electric filed is formed between the metal layer on the outer wall of the insulating casing 513Y and the conductive fiber 505AY. Thus, electrons and ions generated by abnormal discharge in a direction of the electrical field may be kept on the inner wall of the insulating casing 513Y.

Figure 29:
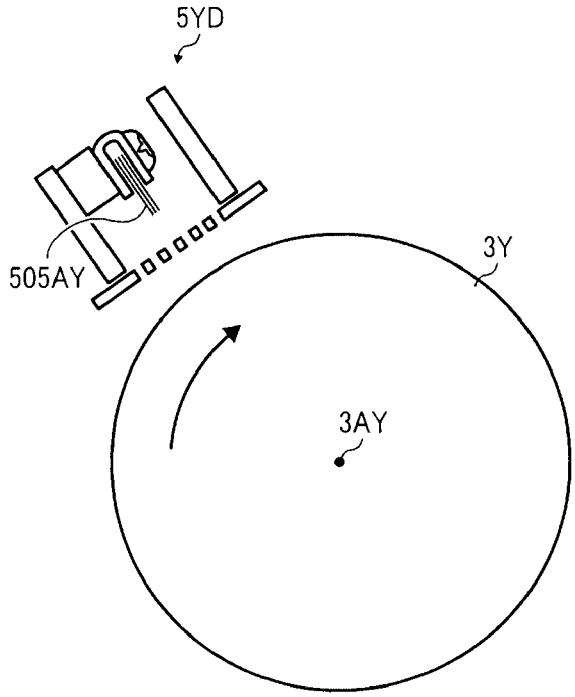
FIG. 29 is a schematic view of a photoconductor included in the image forming apparatus shown in FIG. 1 and the charging device shown in FIG. 26.

FIG. 29 is a schematic view of the charging device 5YD and the photoconductor 3Y. The charging device 5YD is provided in a manner that the top of the conductive fiber 505AY opposes a rotational center 3AY of the photoconductor 3Y. Therefore, electrical discharge occurs between a circumferential surface of the photoconductor 3Y and the conductive fiber 505AY in a direction of a normal line of the circumferential surface of the photoconductor 3Y.

Figure 30A:
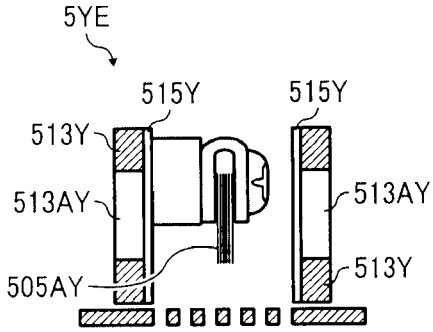
FIG. 30A is a schematic view of a charging device according to yet another exemplary embodiment.
Figure 30B:
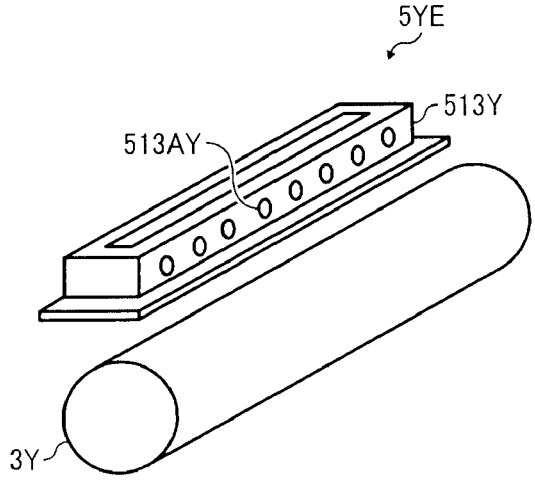
FIG. 30B is a perspective view of the charging device shown in FIG. 30A.

FIG. 30A is a sectional view of a charging device 5YE according to yet another exemplary embodiment. FIG. 30B is a perspective view of the charging device 5YE. The casing 513Y includes a plurality of small openings 513AY. The other elements of the charging device 5YE are common to the charging device 5YD depicted in FIG. 26.

The plurality of small openings 513AY is provided in both sides of the casing 513Y. Since the small opening 513AY has small capacitance, the insulating film 515Y may have a potential equal to that of the conductive fiber 505AY with a decreased amount of electrons.

Figure 31:
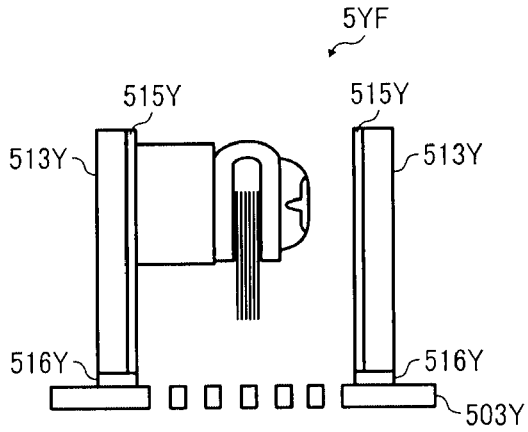
FIG. 31 is a schematic view of a charging device according to yet another exemplary embodiment.

FIG. 31 is a sectional view of a charging device 5YF according to yet another exemplary embodiment. The charging device 5YF includes insulating members 516. The other elements of the charging device 5YF are common to the charging device 5YD depicted in FIG. 26.

The grid electrode 503Y is fixed to the casing 513Y via the insulating members 516 to insulate the grid electrode 503Y from the casing 513Y. Therefore, electrical charges of the grid electrode 503 may be prevented from moving from the casing 513Y to the ground, thereby preventing a waste of power consumption.

Figure 32:
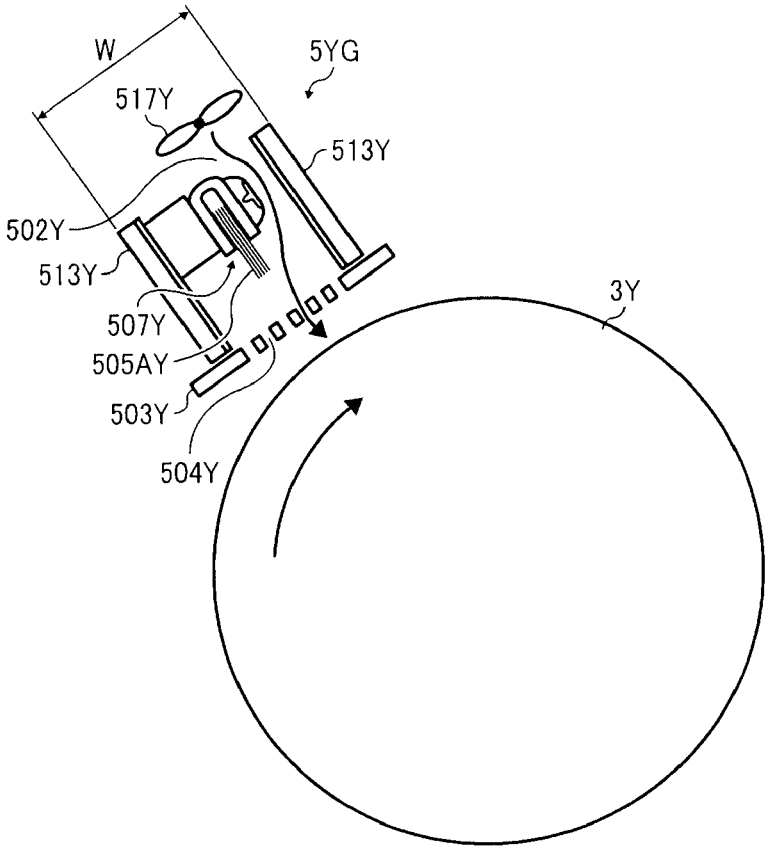
FIG. 32 is a schematic view of a charging device according to yet another exemplary embodiment.

FIG. 32 is a schematic view of a charging device 5YG according to yet another exemplary embodiment. The charging device 5YG includes a ventilation opening 502Y and a fan 517Y. The other elements of the charging device 5YG are common to the charging device 5YD depicted in FIG. 26.

The ventilation opening 502Y is provided in the casing 513Y and opposes the grid electrode 503Y. The fan 517Y is provided in an outside of the casing 513Y, and sends the air toward the ventilation opening 502Y. The fan 517Y moves the air from the ventilation opening 502Y to the surface of the photoconductor 3Y via the charging brush 507Y and the openings 504Y of the grid electrode 503Y, thereby generating electrical discharge from the top of the conductive fiber 505AY to the photoconductor 3Y. Also, the fan 517Y prevents invasion of toner particles into the casing 513Y, so that adhesion of the toner particles to an inside of the casing 513Y may be prevented.

The fan 517Y moves the air with a rotating propeller. The propeller has a circular rotational trajectory. The fan 517Y may have a diameter of rotation of the propeller almost equal to a width W of the casing 513Y, so that the air may be efficiently sent to the ventilation opening 502Y. However, the fan 517Y may not send the air to the whole area of the ventilation opening 502Y in a longitudinal direction of the ventilation opening 502Y (e.g., the longitudinal direction of the photoconductor 3Y). Therefore, in order to flow the air all over the casing 513Y in the longitudinal direction, a plurality of fans 517Y needs to be provided in the longitudinal direction, resulting in cost increase.

Figure 33:
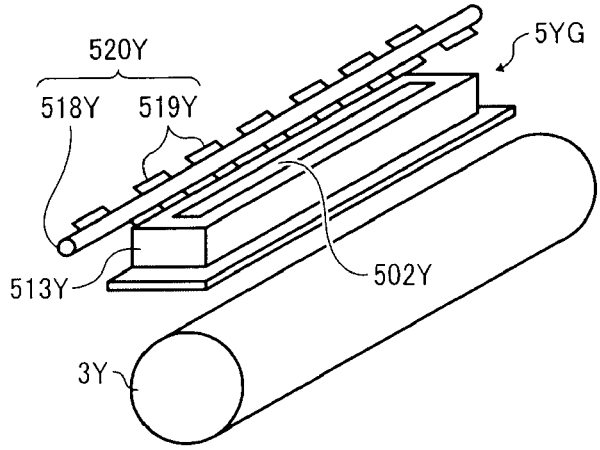
FIG. 33 is a perspective view of one modification example of the charging device shown in FIG. 32.
Figure 34:
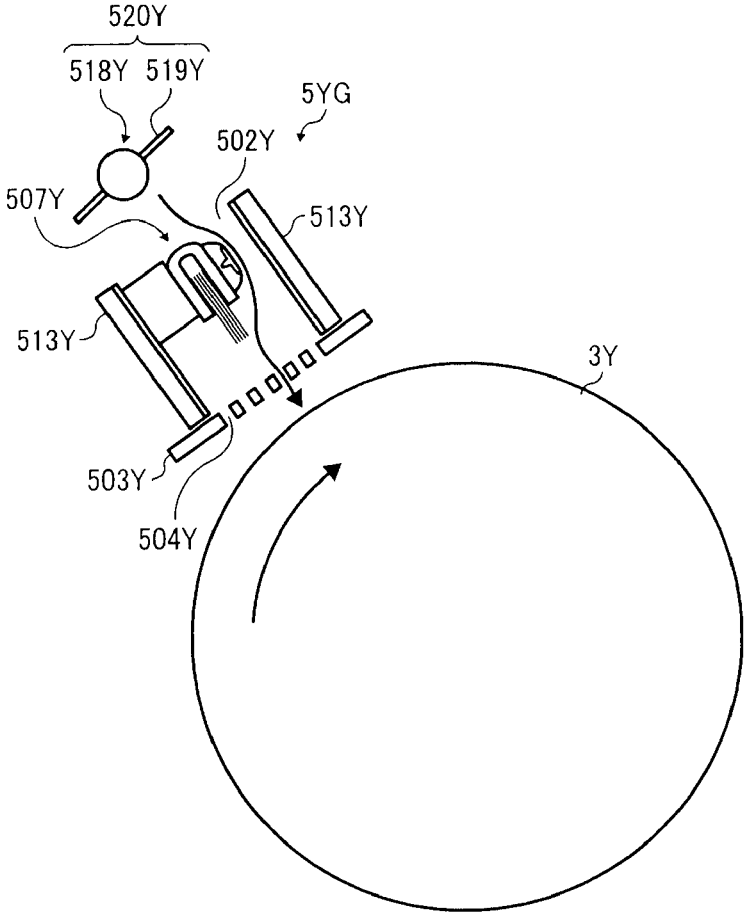
FIG. 34 is a sectional view of the charging device shown in FIG. 33.

FIG. 33 is a perspective view of one modification example of the charging device 5YG. FIG. 34 is a schematic view of the charging device 5YG. The charging device 5YG further includes a paddle 520Y. The paddle 520Y includes a rotation axis 518Y and a plurality of blades 519Y.

As illustrated in FIG. 33, the rotation axis 518Y extends in a longitudinal direction of the casing 513Y. The plurality of blades 519Y stands on a circumferential surface of the rotation axis 518Y.

As illustrated in FIG. 34, the paddle 520Y may send the air to the whole area of the ventilation opening 502Y of the casing 513Y in the longitudinal direction of the ventilation opening 502Y with the plurality of blades 519Y revolving around the rotation axis 518. Therefore, compared to the plurality of fans 517Y depicted in FIG. 32, the paddle 520Y may send more air to the whole area of the ventilation opening 502Y in the longitudinal direction at a low cost.

Figure 35:
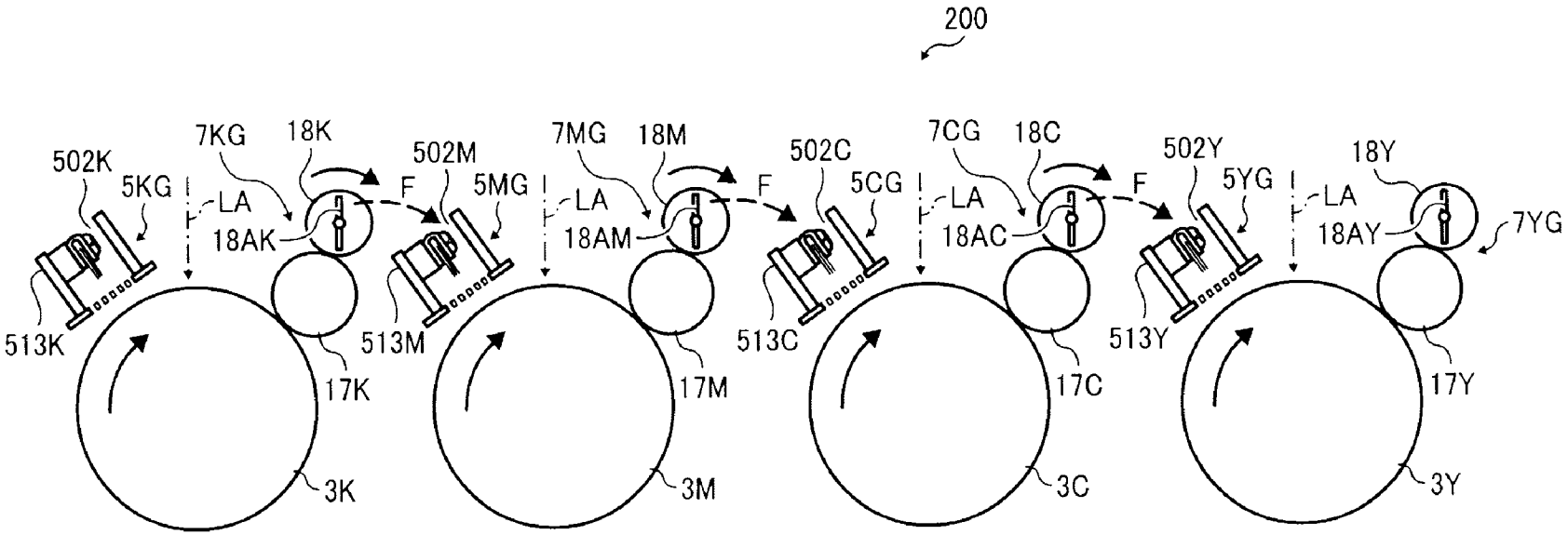
FIG. 35 is a schematic view of a tandem device included in the image forming apparatus shown in FIG. 1.

FIG. 35 is a schematic view of a tandem device of the image forming apparatus 200. The tandem device includes charging devices 5YG, 5CG, 5MG, and 5KG instead of the charging device 5Y (depicted in FIG. 2) and development units 7YG, 7CG, 7MG, and 7KG instead of the development unit 7Y (depicted in FIG. 2). The development units 7YG, 7CG, 7MG, and 7KG include development rollers 17Y, 17C, 17M, and 17K and toner supply rollers 18Y, 18C, 18M, and 18K, respectively. The toner supply rollers 18Y, 18C, 18M, and 18K include blades 18AY, 18AC, 18AM, and 18AK, respectively.

Each of the development units 7YG, 7CG, 7MG, and 7KG uses a one-component development method for developing an electrostatic latent image with toner as one-component developer not including a magnetic carrier.

Toner containers, not shown, are provided in the development units 7YG, 7CG, 7MG, and 7KG, and store yellow, cyan, magenta, and black toner, respectively. Agitators, not shown, are provided in the toner containers, and may rotate to agitate and convey the yellow, cyan, magenta, and black toner. That is, when the agitators rotate in the development units 7YG, 7CG, 7MG, and 7KG, the yellow, cyan, magenta, and black toner are sent toward the toner supply rollers 18Y, 18C, 18M, and 18K, respectively. The toner supply rollers 18Y, 18C, 18M, and 18K include resin foam, and supply the yellow, cyan, magenta, and black toner agitated by the agitators to the development rollers 17Y, 17C, 17M, and 17K, respectively. Upon contact with the development rollers 17Y, 17C, 17M, and 17K, the toner supply rollers 18Y, 18C, 18M, and 18K supply the yellow, cyan, magenta, and black toner to the development rollers 17Y, 17C, 17M, and 17K, respectively. Therefore, at a development area at which the development rollers 17Y, 17C, 17M, and 17K carrying the yellow, cyan, magenta, and black toner oppose the photoconductors 3Y, 3C, 3M, and 3K, respectively, the development rollers 17Y, 17C, 17M, and 17K cause the yellow, cyan, magenta, and black toner to adhere to electrostatic latent images formed on the photoconductors 3Y, 3C, 3M, and 3K, respectively.

Figure 36:
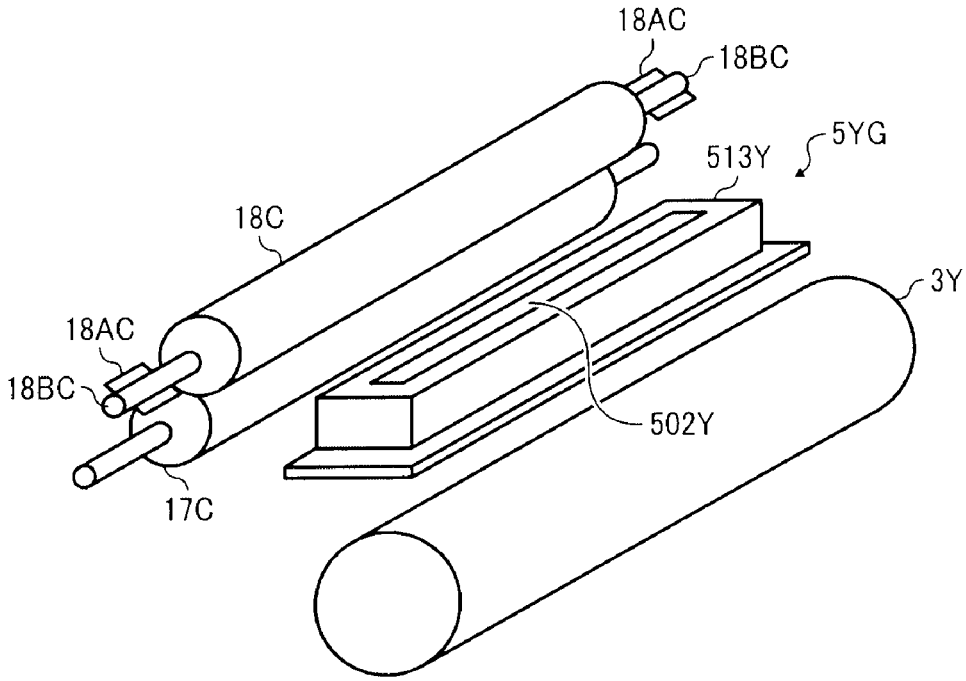
FIG. 36 is a perspective view of a charging device, a development roller, a toner supply roller, and a photoconductor included in the tandem device shown in FIG. 35.
Figure 37:
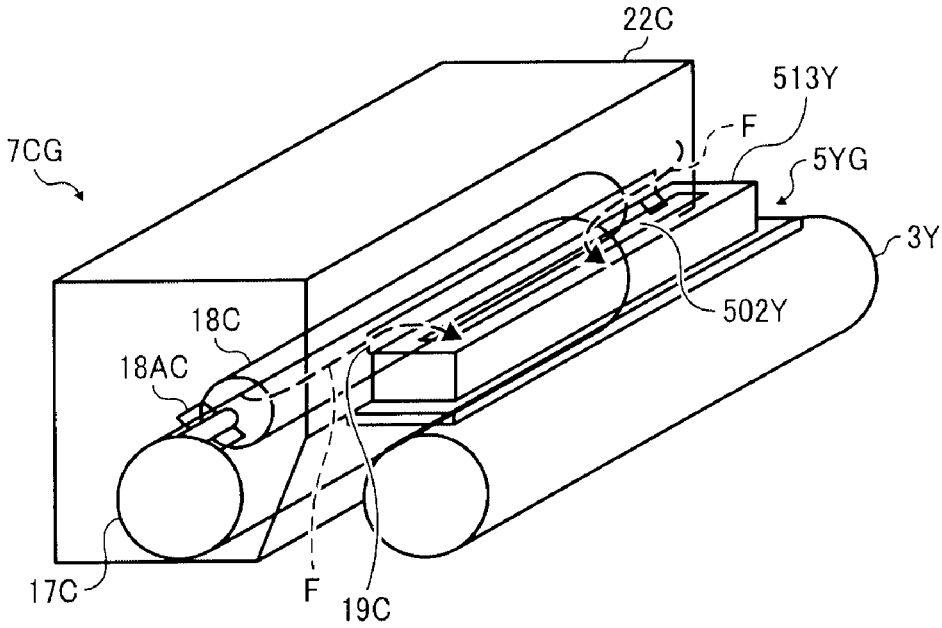
FIG. 37 is a perspective view of the charging device shown in FIG. 36 illustrating a flow of an electrical current entering the charging device.

FIG. 36 is a perspective view of the charging device 5YG, the development roller 17C, the toner supply roller 18C, and the photoconductor 3Y. The toner supply roller 18C further includes an axis 18BC. FIG. 37 is a perspective view of the charging device 5YG, the development unit 7CG, and the photoconductor 3Y. The development unit 7CG includes a casing 22C. The casing 22C includes a ventilation opening 19C.

As illustrated in FIG. 36, the axis 18BC extends from both ends of the toner supply roller 18C in an axial direction (e.g., a longitudinal direction) of the toner supply roller 18C, and is rotatably supported by a receiver, not shown. The blades 18AC protrude from a circumferential surface of the axis 18BC. When the toner supply roller 18C rotates, the blades 18AC revolve around the axis 18BC to generate airflows F (depicted in FIG. 37) at both ends of the toner supply roller 18C in the longitudinal direction of the toner supply roller 18C. As illustrated in FIG. 37, the ventilation opening 19C is provided in the casing 22C and opposes the charging device 5YG. The airflows F generated inside the casing 22C of the development unit 7CG for the cyan toner enter the ventilation opening 502Y of the charging device 5YG via the ventilation opening 19C.

Accordingly, the blades 18AC and the ventilation opening 19C provided in the development unit 7CG for the cyan toner function as a ventilation device for supplying the air to the ventilation opening 502Y of the charging device 5YG for the yellow toner. As illustrated in FIG. 35, the blades 18AK and a ventilation opening, not shown, provided in the development unit 7KG for the black toner function as a ventilation device for supplying the air to the ventilation opening 502M of the charging device 5MG for the magenta toner. Also, the blades 18AM and a ventilation opening, not shown, provided in the development unit 7MG for the magenta toner function as a ventilation device for supplying the air to the ventilation opening 502C of the charging device 5CG for the cyan toner.

Therefore, air supply may be performed by using the components provided in the tandem device without adding any component to the tandem device. A dotted line indicated by "LA" represents a laser beam for exposing and scanning the photoconductor 3Y.

Figure 38:
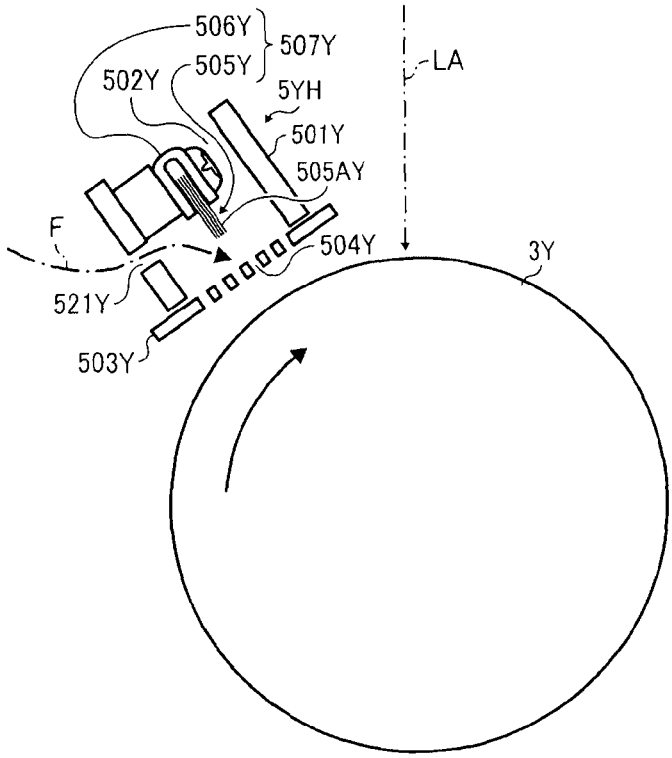
FIG. 38 is a schematic view of a charging device according to yet another exemplary embodiment.

Referring to FIG. 38, a description is now given of a charging device 5YH according to yet another exemplary embodiment. FIG. 38 is a schematic view of the charging device 5YH and the photoconductor 3Y. The casing 501Y includes an air hole 521Y. The other elements of the charging device 5YH are common to the charging device 5YG depicted in FIG. 32, except that the casing 501Y replaces the casing 513Y.

As in the charging device 5Y (depicted in FIG. 7), the casing 501Y of the charging device 5YH includes an insulating material. Four sidewalls of the casing 501Y extend from the grid electrode 503Y to the metal holder 506Y to cover the charging brush 507. One of the sidewalls is positioned downstream from the photoconductor 3Y in a direction of movement of the photoconductor 3Y, and receives an airflow F generated according to rotation of the photoconductor 3Y. The air hole 521Y is provided in the above sidewall.

Accordingly, since the airflow F generated according to rotation of the photoconductor 3Y passes through the air hole 521Y into the casing 501Y, the airflow F may move from the brush 505Y to the openings 504Y of the grid electrode 503Y in the casing 501Y. Therefore, the airflow F generated according to rotation of the photoconductor 3Y may help electrical discharge from the top of the conductive fiber 505AY to the photoconductor 3Y, or may prevent toner particles from adhering to the inside of the casing 501Y.

Figure 39:
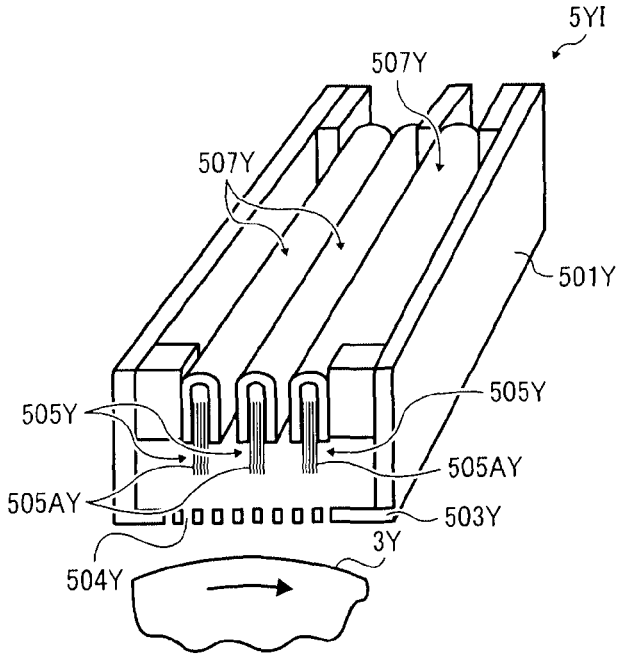
FIG. 39 is a perspective view of a charging device according to yet another exemplary embodiment.

Referring to FIG. 39, a description is now given of a charging device 5YI according to yet another exemplary embodiment. FIG. 39 is a perspective view of the charging device 5YI. The charging device 5YI includes a plurality of brushes 505Y. The other elements of the charging device 5YI are common to the charging device 5Y depicted in FIG. 7.

In order to uniformly charge the photoconductor 3Y, the brush 505Y of the charging brush 507Y needs to have a large area of a brush surface formed by gathering all the tops of the plurality of conductive fibers 505AY. However, when the area of the brush surface is too large, electrical charges hardly gather at each top of the conductive fibers 505AY, thereby increasing discharge starting voltage.

Therefore, according to the present exemplary embodiment, the plurality of brushes 505Y is provided in the charging device 5YI in a direction of movement of the photoconductor 3Y. Thus, each of the brush surfaces of the plurality of brushes 505Y separately opposes the photoconductor 3Y. Therefore, a proper size of the brush surface area necessary for uniformly charging the photoconductor 3Y may be provided without excessively enlarging the brush surface area of one brush 505Y. Accordingly, an increase of the discharge starting voltage due to excessive enlargement of the brush surface area may be prevented, thereby uniformly charging the photoconductor 3Y.

Figure 40:
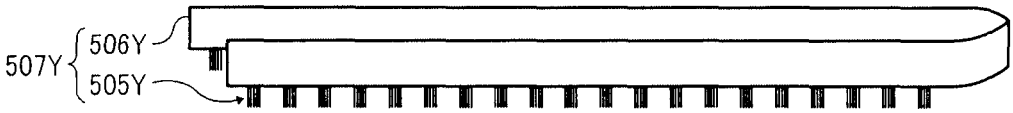
FIG. 40 is a schematic view of a charging brush included in the charging device shown in FIG. 39.

FIG. 40 is a perspective view of one modification example of the charging brush 507Y. The metal holder 506Y for holding the brush 505Y is curved or wound like a snake, for example. Therefore, the single charging brush 507Y may include a plurality of brushes 505Y arranged in the direction of movement of the photoconductor 3Y. When the single metal holder 506Y is fixed to the casing 501Y (depicted in FIG. 39), the plurality of brushes 505Y may be arranged in the direction of movement of the photoconductor 3Y. Accordingly, compared to a structure in which the plurality of charging brushes 507Y is separately fixed to the casing 501Y, the charging brush 507Y depicted in FIG. 40 may be fixed to the casing 501Y with reduced assembly processes.

Figure 41:
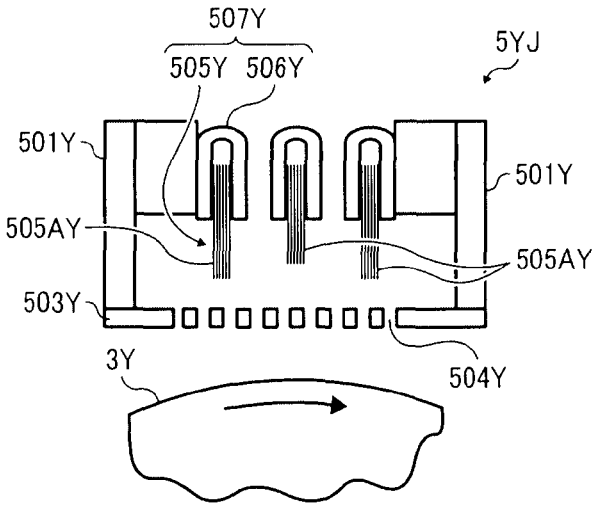
FIG. 41 is a schematic view of a charging device according to yet another exemplary embodiment.

Referring to FIG. 41, a description is now given of a charging device 5YJ according to yet another exemplary embodiment. FIG. 41 is a schematic view of the charging device 5YJ. The charging device 5YJ includes elements common to the charging device 5YI depicted in FIG. 39.

Since the photoconductor 3Y has a drum-like shape, the photoconductor 3Y has a curved surface opposing the charging device 5YJ. When the brush 505Y including a plane brush surface opposes the curved surface of the photoconductor 3Y, a distance between both ends of the brush surface in the direction of movement of the photoconductor 3Y and the photoconductor 3Y is larger than a distance between a center of the brush surface and the photoconductor 3Y. In order to generate electrical discharge from the top of all the conductive fibers 505AY to the photoconductor 3Y, a charging bias needs to be set according to the distance between both ends of the brush surface in the direction of movement of the photoconductor 3Y and the photoconductor 3Y. Thus, the charging bias applied at the both ends may become larger than a charging bias set according to the distance between the center of the brush surface and the photoconductor 3Y.

Thus, as illustrated in FIG. 41, each top of the plurality of conductive fibers 505AY of the brush 505Y is arranged along the curved surface of the photoconductor 3Y. Specifically, as in the above-described exemplary embodiment depicted in FIG. 39, three brushes 505Y are arranged in the charging device 5YJ in the direction of movement of the photoconductor 3Y. However, a length of the conductive fibers 505AY of the brush 505Y provided in the center is shorter than that of the conductive fibers 505AY of each of the brushes 505Y provided at both ends. Therefore, three brushes 505Y are provided in a manner that each top of the plurality of conductive fibers 505AY of the three brushes 505Y is arranged along the surface of the photoconductor 3Y.

Since the distances between each top of the conductive fibers 505AY and the photoconductor 3Y are almost equal, compared to a case in which the distances are different, electrical discharge from each conductive fiber 505AY may occur at an almost common frequency, so that the photoconductor 3Y may be uniformly charged.

When there is provided one brush 505Y including a brush surface with a long length in the direction of movement of the photoconductor 3Y, a length of the conductive fiber 505AY in the center of the brush 505Y in the direction of movement of the photoconductor 3Y may be set to be shorter than that of the conductive fibers 505AY at both ends.

Figure 42:
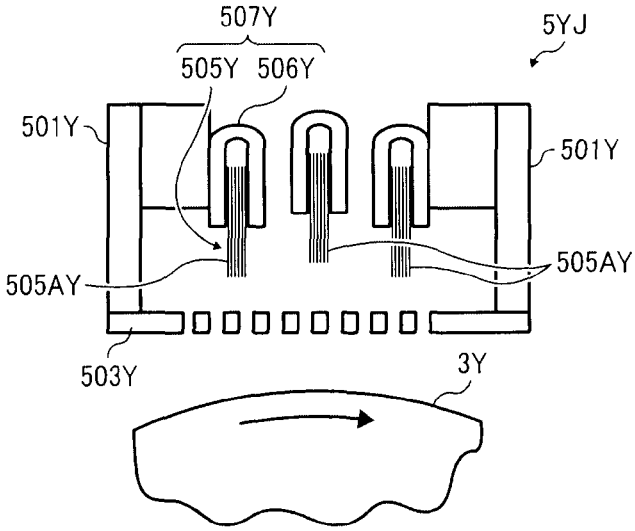
FIG. 42 is a schematic view of one modification example of the charging device shown in FIG. 41.

FIG. 42 is a schematic view of one modification example of the charging device 5YJ. Bases of the plurality of conductive fibers 505AY of the brushes 505Y are arranged along the curved surface of the photoconductor 3Y. Accordingly, the plurality of conductive fibers 505AY having a length equal to each other may be provided, so that the top of the conductive fibers 505AY may be arranged along the curved surface of the photoconductor 3Y. Therefore, the top of the conductive fibers 505AY may be arranged along the curved surface of the photoconductor 3Y without any trouble of disposing the brush 505Y including the conductive fibers 505AY of different length in a predetermined position, or planting the conductive fibers 505AY of different length in a predetermined position in the metal holder 506Y.

Figure 43:
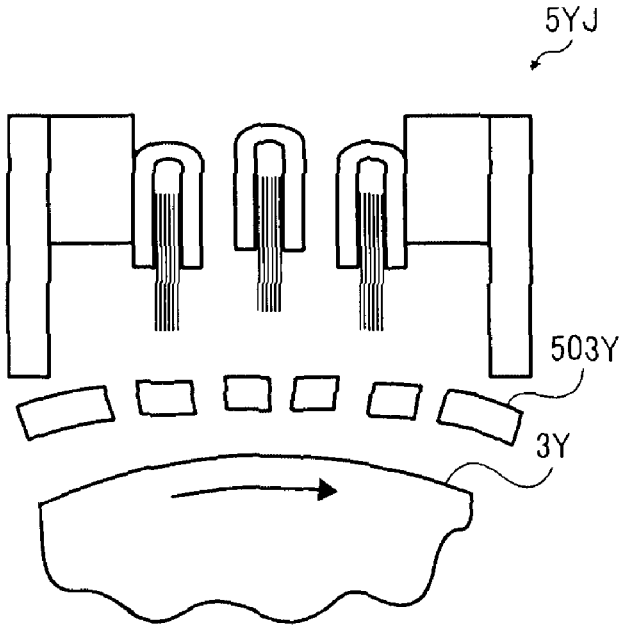
FIG. 43 is a schematic view of another modification example of the charging device shown in FIG. 41.

FIG. 43 is a sectional view of another modification example of the charging device 5YJ. In addition to the above modification, the grid electrode 503Y is curved along the curved surface of the photoconductor 3Y. Therefore, a constant distance is provided between the photoconductor 3Y and the grid electrode 503Y in the direction of movement of the photoconductor 3Y, thereby preventing a decrease of discharge effect due to varied distance between the photoconductor 3Y and the grid electrode 503Y.

Figure 44:
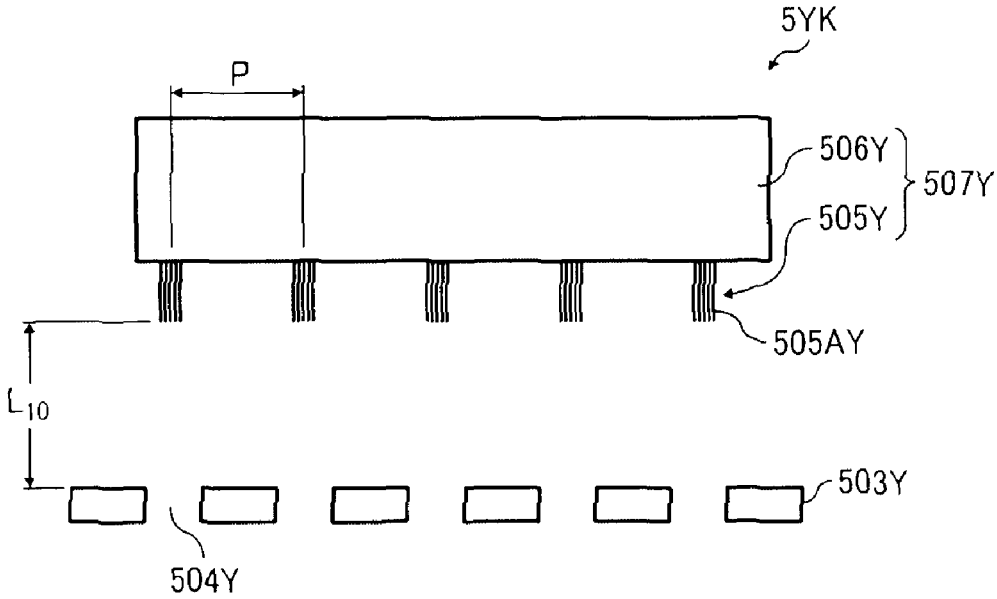
FIG. 44 is a partial schematic view of a charging device according to yet another exemplary embodiment.

Referring to FIG. 44, a description is now given of a charging device 5YK according to yet another exemplary embodiment. FIG. 44 is a sectional view of the charging device 5YK.

As described above, the enlargement of the brush surface area of one brush 505Y may increase discharge starting voltage. The discharge starting voltage may increase not only when a length of the brush surface area of one brush 505Y is excessively elongated in the direction of movement of the photoconductor 3Y, but also when a length of the brush surface area is excessively elongated in a longitudinal direction of the brush 505Y, that is, a direction perpendicular to the direction of movement of the photoconductor 3Y. Therefore, the brush 505Y of the charging brush 507Y includes a portion (e.g., a brush portion), in which the conductive fibers 505AY are provided, and a portion (e.g., a non-brush portion), in which no conductive fibers 505AY is provided, alternately disposed in a longitudinal direction of the charging brush 507Y. Therefore, an increase of discharge starting voltage due to excessive enlargement of the brush surface area of one brush 505Y may be prevented, so that the photoconductor 3Y may be uniformly charged.

As illustrated in FIG. 44, the above-described brush portions are disposed at an equal pitch P in the longitudinal direction of the discharging brush 507Y. The grid electrode 503Y includes a plurality of openings 504Y arranged in a grid pattern. Like the brush portions, the openings 504Y are also arranged at an equal pitch P in the longitudinal direction of the charging brush 507Y. Each brush portion is positioned above one of the plurality of openings 504Y of the grid electrode 503Y, so as to directly oppose the photoconductor 3Y through the opening 505Y. Therefore, electrical discharge from the top of the conductive fibers 505AY may occur easily, so that discharge starting voltage may be reduced. Moreover, electrical discharge from the top of each of the conductive fibers 505AY may occur at a reduced discharge starting voltage, thereby preventing the photoconductor 3Y from being non-uniformly charged.

As in the above-described exemplary embodiments depicted in FIGS. 41 to 43, the plurality of brushes 505Y is arranged in the direction of movement of the photoconductor 3Y at an arrangement pitch equal to the pitch P of the opening 504Y of the grid electrode 503Y in the direction of movement of the photoconductor 3Y. Each brush 505Y is disposed above each opening 504Y of the grid electrode 503Y.

Figure 45:
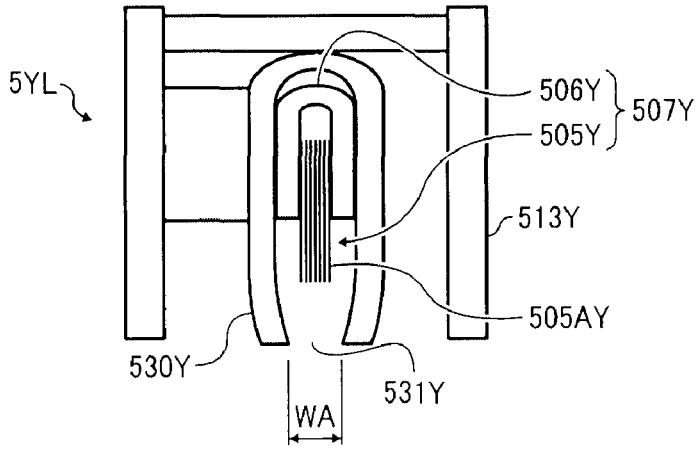
FIG. 45 is a schematic view of a charging device according to yet another exemplary embodiment.

Referring to FIG. 45, a description is now given of a charging device 5YL according to yet another exemplary embodiment. FIG. 45 is a sectional view of the charging device 5YL. The charging device 5YL includes an opening electrode 530Y. The opening electrode 530Y includes an opening 531Y. The opening electrode 530Y replaces the grid electrode 503Y depicted in FIG. 17. The other elements of the charging device 5YL are common to the charging device 5YA depicted in FIG. 17.

Instead of the grid electrode 503Y, the opening electrode 530Y is provided in the charging device 5YL. The opening electrode 530Y is formed by folding one piece of plate-like member into a U-like shape. The opening 531Y is slit-shaped. A width WA of the slit-like opening 531Y is almost equal to a width of the opening 504Y of the grid electrode 503Y (depicted in FIG. 17).

The charging brush 507Y is fixed to an inside of the opening electrode 530Y folded into the U-like shape. Therefore, electrical discharge may occur between the top of the conductive fiber 505AY of the charging brush 507Y and the photoconductor 3Y (depicted in FIG. 17) via the opening 531Y of the opening electrode 530Y.

Accordingly, compared to the charging device 5YA (depicted in FIG. 17) including the grid electrode 503Y, a size of the charging device 5YL in the direction of movement of the photoconductor 3Y may be decreased.

Figure 46:
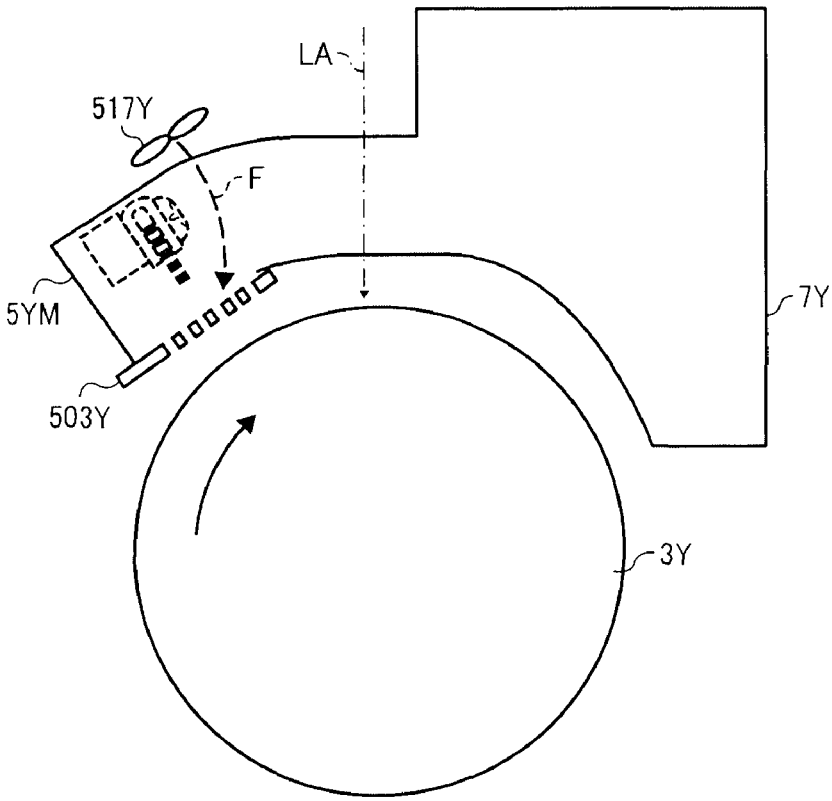
FIG. 46 is a schematic view of a charging device according to yet another exemplary embodiment.

Referring to FIG. 46, a description is now given of a charging device 5YM of the image forming apparatus 200 according to yet another exemplary embodiment. FIG. 46 is a schematic view of the charging device 5YM, the development unit 7Y, and the photoconductor 3Y.

As illustrated in FIG. 46, a casing of the charging device 5YM is integrated into a casing of the development unit 7Y, thereby the charging device 5YM may become compact.

A ventilation opening, not shown, is provided in the casing of the charging device 5YM. The fan 517Y opposes the ventilation opening.

As illustrated in FIG. 7, according to the above-described exemplary embodiments, electrical discharge occurs from each top of a plurality of conductive fibers (e.g., the plurality of conductive fibers 505AY depicted in FIG. 8) of a charging brush (e.g., the charging brush 507Y). Since an arrangement pitch of the plurality of conductive fibers is smaller than an arrangement pitch of teeth of a charging device including a sawtooth discharging electrode, a latent image carrier (e.g., the photoconductor 3Y) may be uniformly charged. Even when the plurality of conductive fibers is provided in very high density such that the conductive fibers contact each other, the plurality of flexible conductive fibers bends due to a repulsion force of electrical charges concentrating at a top of the plurality of conductive fibers, and separates from each other, thereby the electrical charges are separately concentrated at each top of the plurality of conductive fibers. As a result, electrical discharge may occur at a low electric potential at each top of the plurality of conductive fibers arranged in high density, so that the image carrier may be charged at a lower electric potential than a conventional charging device.

The image forming apparatus 200 (depicted in FIG. 1) may be a copier, a facsimile machine, a printer, a multifunction printer having two or more of copying, printing, scanning, and facsimile functions, or the like. According to the above-described non-limiting example embodiments, the image forming apparatus 200 functions as a tandem type color printer for forming a color image on a recording medium (e.g., a sheet) by electrophotography. However, the image forming apparatus 200 is not limited to the color printer and may form a color and/or monochrome image with other structure.

As can be appreciated by those skilled in the art, although the present invention has been described above with reference to specific exemplary embodiments the present invention is not limited to the specific embodiments described above, and various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A charging brush unit for uniformly charging a surface of a latent image carrier, comprising:

a brush including a plurality of flexible conductive fibers, the plurality of flexible conductive fibers supplied with a charging bias to generate an electrical discharge between a top of the plurality of conductive fibers and the latent image carrier across a gap formed between the top of the plurality of conductive fibers and the latent image carrier;

an electrode provided in the gap and including a plurality of openings opposing the top of the plurality of conductive fibers and supplied with a bias different from the charging bias applied to the plurality of conductive fibers; and a conductive holder configured to hold the brush, wherein an absolute value of the charging bias is between 1 kV and 4 kV.

2. A charging device for uniformly charging a surface of a latent image carrier, comprising:

a charging brush unit; and an electrode, the charging brush unit comprising:

a brush including a plurality of flexible conductive fibers supplied with a charging bias to generate electrical discharge between a top of the plurality of conductive fibers and the latent image carrier across a gap formed between the top of the plurality of conductive fibers and the latent image carrier; and a conductive holder configured to hold the brush, wherein the electrode includes a plurality of openings opposing the top of the plurality of conductive fibers, the electrode is supplied with a bias different from the charging bias applied to the plurality of conductive fibers to generate the electrical discharge between the plurality of conductive fibers and the latent image carrier via the electrode, and an absolute value of the charging bias is between 1 kV and 4 kV.

3. The charging device according to claim 2, wherein a top portion of each conductive fiber of the plurality of conductive fibers is tapered.

4. The charging device according to claim 2, wherein the brush is held by the conductive holder with the plurality of conductive fibers bundled together.

5. The charging device according to claim 4, wherein a relation between a distance L from a top edge of the plurality of conductive fibers to the latent image carrier and a pitch P of the plurality of conductive fibers in the longitudinal direction of the brush is represented by $P \leqq L$.

6. The charging device according to claim 2, further comprising a cover configured to cover the brush except for a top surface thereof opposing the electrode together with the conductive holder.

7. The charging device according to claim 6, wherein the cover comprises an insulating material.

8. The charging device according to claim 6, wherein the cover includes an opening configured to externally expose an end of the conductive holder opposite to another end thereof at which the brush is held in a direction perpendicular to an axis of the image carrier.

9. The charging device according to claim 6, wherein the cover includes an opening provided in one of a plurality of sidewalls extending from the electrode to the conductive holder to cover the charging brush unit, and the charging brush unit is provided substantially beneath the latent image carrier.

10. The charging device according to claim 6, wherein the cover comprises a conductive material, and wherein a distance between a base of the conductive fiber of the brush provided inside the cover and an inner wall of the cover is longer than a distance obtained by adding a length of the conductive fiber to a discharge starting distance between the conductive fiber supplied with the charging bias and the inner wall of the cover.

11. The charging device according to claim 6, further comprising a blocking member configured to prevent excessive bending of the conductive fiber inside the cover, wherein the cover includes a conductive material.

12. The charging device according to claim 6, further comprising a directionality improvement member configured to improve directionality of discharge from the top of the conductive fiber to the electrode inside the cover.

13. The charging device according to claim 12, wherein the directionality improvement member includes an electrical charge holder configured to provide an inner wall of the cover with an electrical charge of a polarity identical to a polarity of the charging bias.

14. The charging device according to claim 2, further comprising a plurality of brushes arranged in a direction of movement of the latent image carrier.

15. The charging device according to claim 2, wherein the top of the plurality of conductive fibers of the brush is disposed along and above a curved surface of the latent image carrier.

16. The charging device according to claim 2, wherein the electrode is curved along a curved surface of the latent image carrier.

17. The charging device according to claim 2, further comprising a latent image carrier configured to carry a latent image, wherein the charging brush unit and the latent image carrier are detachably attachable to an image forming apparatus.

18. The charging device according to claim 2, wherein the plurality of conductive fibers are flexible so as to bend in reaction to the electrical discharge from the top thereof.

19. The charging device according to claim 2, wherein the plurality of conductive fibers have a diameter of from substantially 0.1 μm to about 100 μm and the plurality of conductive fibers in the axial direction of the latent image carrier is from substantially 10 fibers/mm to substantially 10,000 fibers/mm.

20. An image forming apparatus comprising:

a latent image carrier configured to carry a latent image;

a charging device configured to uniformly charge a surface of the latent image carrier;

a latent image forming member configured to form a latent image on the uniformly charged surface of the latent image carrier; and a development device configured to develop the latent image, the charging device comprising:

a charging brush unit; and an electrode, the charging brush unit comprising:

a brush including a plurality of flexible conductive fibers supplied with a charging bias to generate electrical discharge between a top of the plurality of conductive fibers and the latent image carrier across a gap formed between the top of the plurality of conductive fibers and the latent image carrier; and a conductive holder configured to hold the brush, wherein the electrode includes a plurality of openings opposing the top of the plurality of conductive fibers, the electrode is supplied with a bias different from the charging bias applied to the plurality of conductive fibers to generate the electrical discharge between the plurality of conductive fibers and the latent image carrier via the electrode, and an absolute value of the charging bias is between 1 kV and 4 kV.

* * * * *